US007654821B2

(12) United States Patent
Vitantonio et al.

(10) Patent No.: US 7,654,821 B2
(45) Date of Patent: Feb. 2, 2010

(54) FLINT IGNITED PREMIXED LIGHTER

(75) Inventors: Marc L. Vitantonio, South Russell, OH (US); Craig M. Saunders, Rocky River, OH (US); Charles P. Althoff, Cleveland Heights, OH (US); David J. Boll, Avon, OH (US); Michael W. Johnson, Port Allegany, PA (US); Jeffrey M. Kalman, Cleveland Heights, OH (US); Michael P. O'Toole, Parma, OH (US); Ronald J. Meister, Bradford, PA (US)

(73) Assignee: Zippo Manufacturing Company, Bradford, PA (US)

( * ) Notice: Subject to any disclaimer, the term of this patent is extended or adjusted under 35 U.S.C. 154(b) by 670 days.

(21) Appl. No.: 11/045,154

(22) Filed: Jan. 31, 2005

(65) Prior Publication Data

US 2005/0181320 A1 Aug. 18, 2005

Related U.S. Application Data

(60) Provisional application No. 60/545,431, filed on Feb. 17, 2004.

(51) Int. Cl.
*F23Q 2/08* (2006.01)

(52) U.S. Cl. ..... 431/131; 431/277; 431/349; 431/350; 431/354

(58) Field of Classification Search ..... 431/131, 431/349–355, 277
See application file for complete search history.

(56) References Cited

U.S. PATENT DOCUMENTS

| | | | |
|---|---|---|---|
| 2,734,364 | A | 2/1956 | Peterson |
| 2,759,345 | A | 8/1956 | Peterson |
| 4,466,788 | A | 8/1984 | Nitta |
| 4,929,174 | A | 5/1990 | Wang |
| 5,055,034 | A | 10/1991 | Wang |
| 5,308,240 | A | 5/1994 | Lowenthal |
| 5,310,336 | A | 5/1994 | Segawa |
| 5,584,681 | A | 12/1996 | Suzuki |
| 5,716,204 | A | 2/1998 | Mifune |
| 6,015,286 | A | 1/2000 | Maruyama |
| 6,135,761 | A | 10/2000 | Chen |

(Continued)

FOREIGN PATENT DOCUMENTS

| | | | |
|---|---|---|---|
| GB | 1452264 | * | 8/1972 |

(Continued)

OTHER PUBLICATIONS

Non-Final Office Action, Paper No. 20060608, mailed Jun. 21, 2006, in U.S. Appl. No. 10/974,775, 9 pp.

(Continued)

*Primary Examiner*—Alfred Basichas
(74) *Attorney, Agent, or Firm*—Bryan Cave LLP

(57) ABSTRACT

A lighter includes a butane fuel reservoir, a valve, a mixer with a choke, a movable combustion space and movable top door over the combustion space which interact to allow a wheel and flint igniter to initiate a post mix flame above the top of the combustion space followed by the opening of the top and migration of the flame into the combustion space to create a strong torch-like premixed flame thereafter.

10 Claims, 32 Drawing Sheets

U.S. PATENT DOCUMENTS

| | | | |
|---|---|---|---|
| 6,537,062 | B1 | 3/2003 | Wong |
| 6,558,156 | B2 | 5/2003 | Wong |
| 6,773,258 | B1 | 8/2004 | Wong |
| 6,780,006 | B1 | 8/2004 | Wong |
| 6,827,572 | B2 | 12/2004 | Wong |
| 6,884,063 | B2 | 4/2005 | Wong |
| 6,905,329 | B2 | 6/2005 | Wong |
| 7,214,055 | B2 | 5/2007 | Meister et al. |
| 2002/0187446 | A1 | 12/2002 | Wong |
| 2002/0197579 | A1 | 12/2002 | Wong |
| 2004/0096793 | A1 | 5/2004 | Wong |

FOREIGN PATENT DOCUMENTS

| | | | |
|---|---|---|---|
| GB | 2 216 244 | A | 10/1989 |
| GB | 2 259 755 | A | 3/1993 |

OTHER PUBLICATIONS

Amendment filed on Dec. 15, 2006 via EFS-Web in U.S. Appl. No. 10/974,775, 14 pp.

Notice of Allowability, Paper No. 20070227, PTOL-37, in U.S. Appl. No. 10/974,775, 1 p.

* cited by examiner

FLINT IGNITED PREMIXED LIGHTER

CROSS REFERENCE TO RELATED APPLICATION

This application claims the benefit of U.S. Provisional Application No. 60/545,431, filed Feb. 17, 2004, the entire contents of which are hereby incorporated by reference.

BACKGROUND OF THE INVENTION

The present invention relates to a lighter of the type used by consumers to light cigarettes, cigars, and pipes and more particularly to a lighter using butane fuel to create a directed flame.

Lighters have been known and used for many years. One type of conventional lighter uses a fuel which is liquid but volatile at normally encountered environmental temperatures (about 25° F. to 90° F.). This type of lighter comprises a fiber filled fuel reservoir surrounded by a metallic case. A wick extends from the fiber filled fuel reservoir into a combustion chamber outside of the fuel reservoir which is surrounded by a wind screen. On one side of the combustion chamber, a rotatable steel wheel having a rough surface rests against a flint which is spring biased into engagement with the steel wheel. When the steel wheel is rotated, particles of the flint are separated from the flint body, become incandescent and are projected into the combustion chamber near the fuel soaked wick. Fuel vapor evaporating from the wick is ignited by the sparks created by the flint and steel at the location surrounding the wick where the fuel vapor mixes with air. This produces a flame surrounding the wick. The combustion created by this type of lighter is called "post mix" combustion because the fuel and air is mixed in the combustion chamber at the point of combustion.

The word "flint" is used herein to mean the commercially available consumer product called "flint" or in the plural, "flints". This product is not normally the historical stone "flint" but is a manufactured product including rare earth metals such as cerium and other elements. These "flints" are often sold in a package of several units formed into small cylinders for use with cigarette lighters and are widely commercially available. They will not be further described herein. It will be appreciated that the word flints and the word flint are used in the specification to mean these products, variations of these products and other commercially available products which, when abraded with a serrated steel or iron wheel, produce incandescent particles capable of initiating combustion of a fuel and air mixture.

The flint and steel or iron wheel ignition system has an advantage when compared to many other systems in that a single stroke by the thumb against the iron wheel produces many incandescent sparks of a temperature sufficient to ignite a fuel and air mixture. As many sparks are produced, the likelihood of an incandescent spark interacting with an appropriate fuel air mixture volume is high and reliable operation becomes more likely.

Another type of conventional cigarette lighter uses butane fuel. "Butane" fuel is used herein to mean a fuel which, at normally encountered atmospheric temperature and pressure, is gaseous if unrestrained. However, "butane" fuel is easily compressed into a liquid state at normally encountered atmospheric temperature and pressure conditions. Thus, butane fuel can be sold in the pressurized liquid state which is easily handled by consumers and loaded into a sealed chamber in a cigarette lighter. When a vent or nozzle on such a sealed container of butane is opened, butane gas will be released and butane liquid within the container or reservoir will quickly turn into a gas so long as the pressure is reduced to atmospheric. The chemical butane answers this description. However, butane gas mixed with other organic chemicals in minor amounts will also meet this description. The word butane is used herein to mean commercially available lighter fuels and other available similar fuels answering the same functional description.

Many conventional butane lighters comprise a reservoir of butane fuel connected to a lever operated valve which is in turn connected to a mixing arrangement adding air to the fuel which is fed to a nozzle. A piezoelectric igniter is used. A user operates the lighter by depressing a button with a thumb which opens the fuel valve and operates the piezoelectric igniter. Fuel passes through the fuel valve into the mixer where it is mixed with air and then exits through the nozzle as a jet. The single spark created by the piezoelectric igniter then ignites the flame providing a torchlike blue flame. The flame is different from a post mix flame in that it is ignited and burns as a premixed mixture of fuel and air in the combustion chamber. The mixing of fuel and air occurs prior to combustion. The resulting combustion and flame are described as premix. This results in a more forceful directable flame. Flint and wheel igniters do not operate well with these premix flame producing structures. It is thought that the higher velocity of the gases exiting the nozzle as a jet reduces the effectiveness of flint and wheel igniters. Piezoelectric igniters create only a single spark on each actuation. Such lighters do not always ignite in response to actuation. Reliability needs improvement. However, premix lighters do provide a hotter, more directable and stable flame. The premix flame is also less likely to be extinguished by wind. Premix nozzles and burner parts are more easily clogged by dirt or debris. Piezoelectric igniters are more expensive than flint and wheel igniters.

A third type of lighter uses butane in a reservoir under pressure and a flint and wheel igniter. The butane reservoir is connected to a valve which is in turn connected to a nozzle. When the user wishes to operate the lighter, he uses a thumb to rotate the wheel and then to press a thumb button which opens the butane valve. The butane gas exits through the valve and the nozzle into a combustion chamber where it mixes with air and forms, after ignition, a post mix flame similar to what is seen with a liquid fuel lighter. The post mix gasses are ignited by the incandescent flint particles just as with a conventional liquid fuel lighter. This third type of conventional lighter uses butane gas but uses it to create a post mix flame, not a premix flame.

SUMMARY OF THE INVENTION

It is an object of the present invention to provide a lighter having the reliable ignition characteristics of a flint and steel or iron wheel igniter producing a strong premix flame.

Another object of the present invention is to provide a lighter having a forceful directable flame which can be reliably and repeatedly ignited.

It is still another object of the present invention to provide a lighter having a forceful directable flame in which the operable nozzle parts are protected from the debris created by a flint and wheel type igniter.

It is still another object of the present invention to provide a lighter which operates in a way sufficiently similar to conventional lighters to be intuitive to the end user.

It is still another object of the present invention to provide a lighter which is robust in design, easy to manufacture, operates reliably and produces a torch-like strong directable flame.

It is another object of the invention to provide a lighter which is not prone to unintended ignition.

In accordance with the present invention, there is provided a lighter comprising a fuel reservoir adapted to contain butane fuel, a fuel valve regulating an output from the fuel reservoir, a mixer receiving fuel from the fuel valve and selectably mixing the fuel with air to create a combustible air-fuel mixture, a nozzle receiving the fuel from the mixer arid directing the flow of fuel through the nozzle into a combustion space and a flint and wheel type igniter adjacent the combustion space adapted to introduce incandescent flint sparks into the path of the fuel flow initiating combustion.

Yet further in accordance with the invention, a choke is provided at the mixer, the choke having a closed position in which air is not admitted to the mixer and an open position in which air is admitted to the mixer allowing the creation of a fuel air premix in the mixer.

Still further in accordance with the invention, at least one closure element is provided adjacent the combustion space, the closure element substantially but not completely closing the combustion space when in a closed position and opening the top of the combustion space when in the opened position.

Yet further in accordance with the present invention, the closure element is a cover closing the lop boundary of the combustion space except for a small aperture through which combustion gas may pass and over which sparks from the flint and wheel igniter pass.

Still further in accordance with the invention, the combustion space cover may be a one or two piece cover having a small aperture in the closed position, and, opening to allow passage of the combustion space past the one piece cover or between the two piece cover thereby elevating the combustion space relative to the top of the lighter after initiation of a flame.

Yet further in accordance with the invention, the combustion space of a butane premixed fuel lighter is surrounded by a heat shield which moves upwardly with the combustion space when a flame is ignited.

Yet further in accordance with the invention, a butane premixed fuel lighter comprises a butane fuel reservoir having an outlet at a valve, the valve selectively supplying butane gas to a mixer with a choke which in turn supplies fuel gas and selectively air to a nozzle introducing fuel gas into a combustion chamber, a movable combustion chamber top wall having a small aperture therein and a wheel and flint igniter adjacent said combustion chamber top wall adapted to direct a stream of sparks over said small aperture and a thumb actuator button adjacent said wheel and flint igniter whereby an operator may operate the lighter by depressing the flint wheel to open the gas valve and rotating the wheel with the operator's thumb; having the thumb then depress the thumb button upon completion of the rotation of the wheel thereby actuating a rack and pinion which opens the reservoir valve, thereby directing gas through the mixer and combustion chamber and outwardly through the small aperture where it is ignited as a post mix flame; starts to elevate the nozzle in the combustion chamber, open the choke and open the combustion chamber top wall whereby the flame starts a transition into a premix flame; and, when said thumb actuator is in the bottommost position, fully open the choke and elevate the combustion space producing a fully premix torch-like flame for so long as the thumb actuator is depressed.

BRIEF DESCRIPTION OF THE DRAWINGS

The foregoing objects, and others, will in part be obvious and in part be pointed out more fully hereinafter in conjunction with the written description of preferred embodiments of the invention illustrated in the accompanying drawings in which.

DESCRIPTION OF THE PREFERRED EMBODIMENTS

Figure 1:
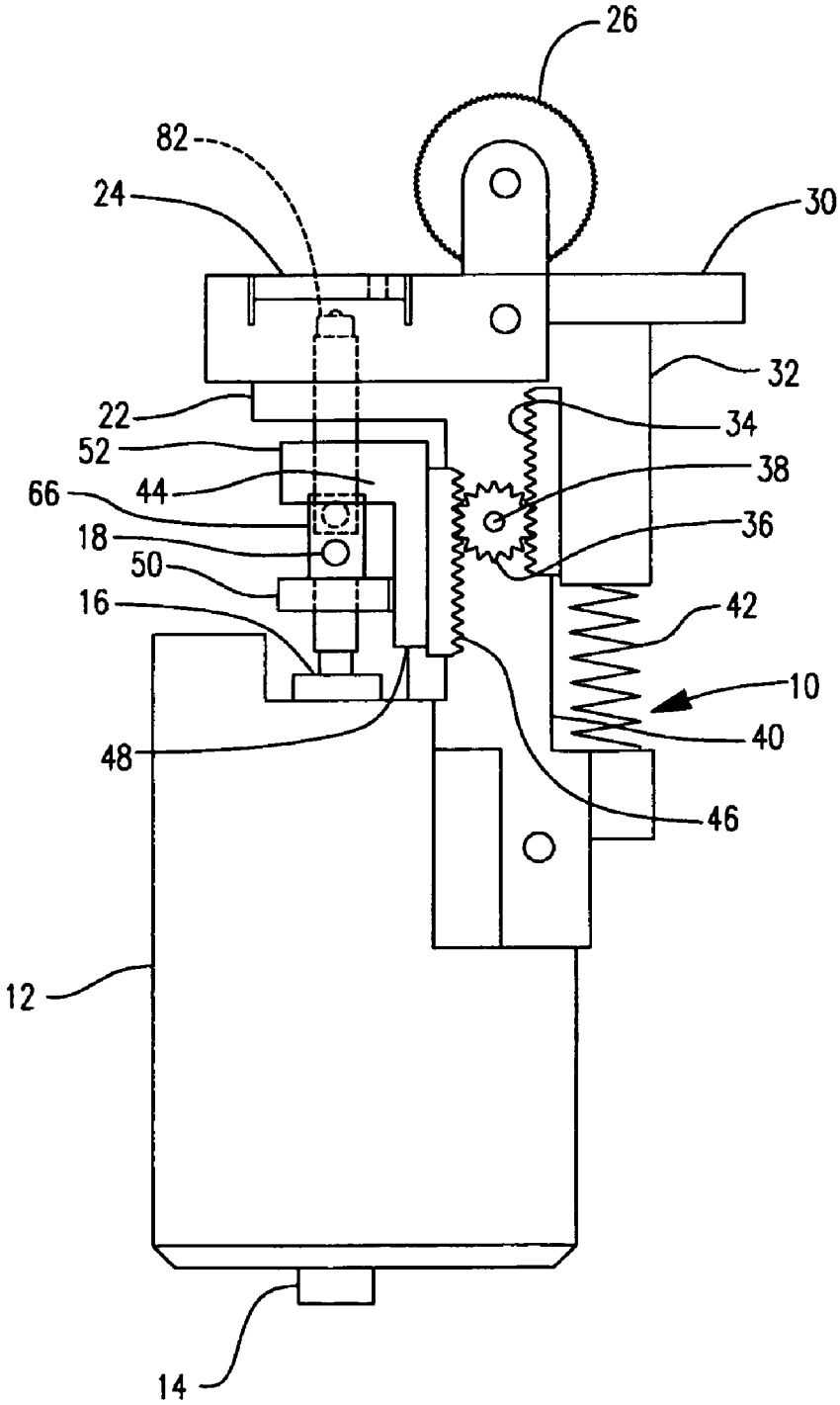
FIG. 1 is a schematic side elevational view of a lighter in accordance with the present invention.

Referring now in greater detail to the drawings, where in the showings are for the purposes of illustrating preferred embodiments of the invention and not for the purposes of limiting same, a lighter 10 is shown in FIG. 1 in side elevation view. The lighter is shown in a somewhat exploded view to more clearly illustrate the elements comprising the lighter 10. A fuel reservoir 12 is disposed at the bottom of the lighter 10 a knurled and slotted adjustment sleeve surrounds a butane filling port at the bottom of the reservoir 12. The words bottom and top are used herein to refer to portions and orientations of the lighter 10 when the lighter is in a conventional orientation. It should be appreciated that the lighter can be stored and used in positions other than that described herein.

Figure 9:
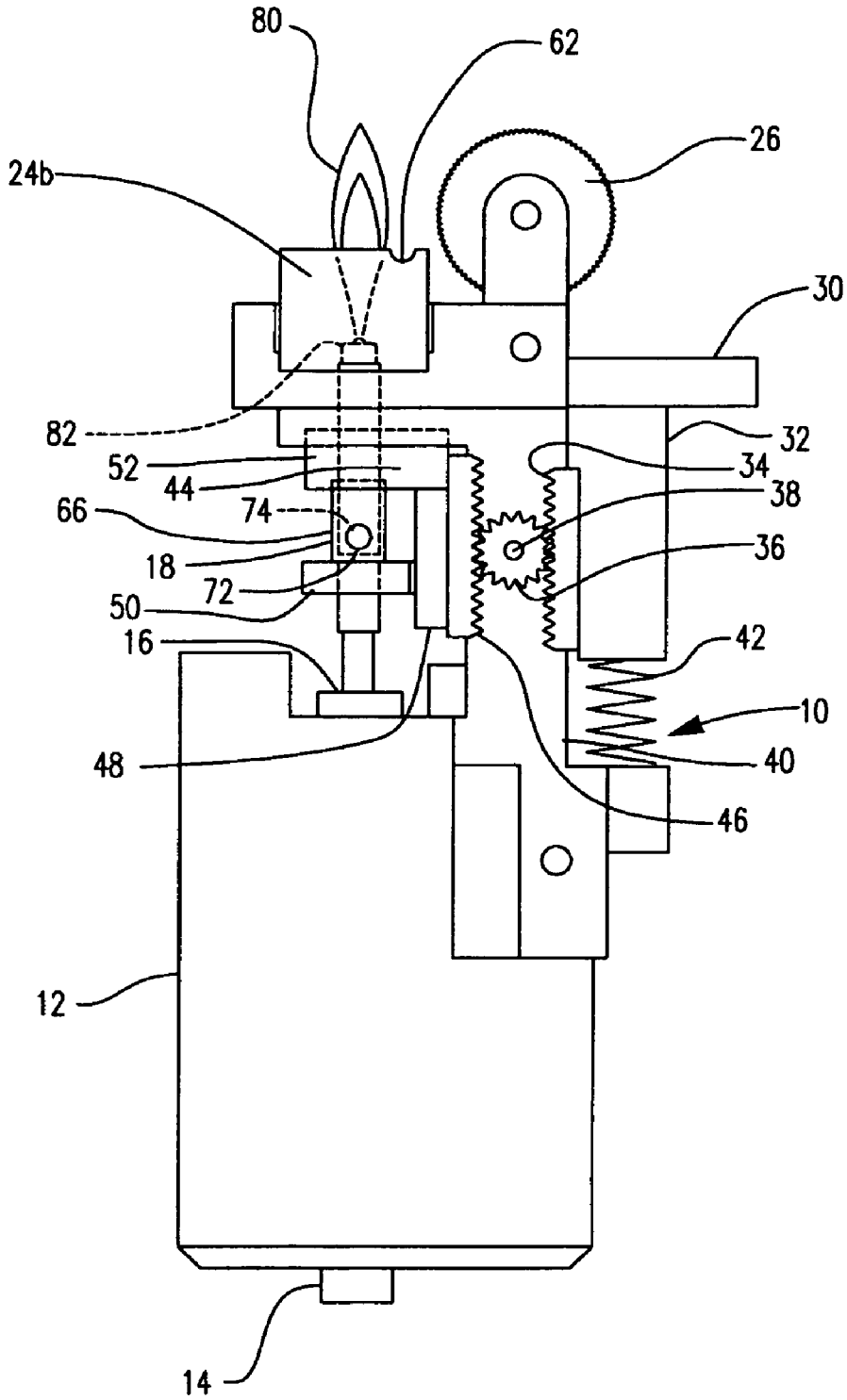
FIG. 9 is a view similar to FIGS. 1, 3, 5 and 7 showing the rack and pinion bottomed.
Figure 25:
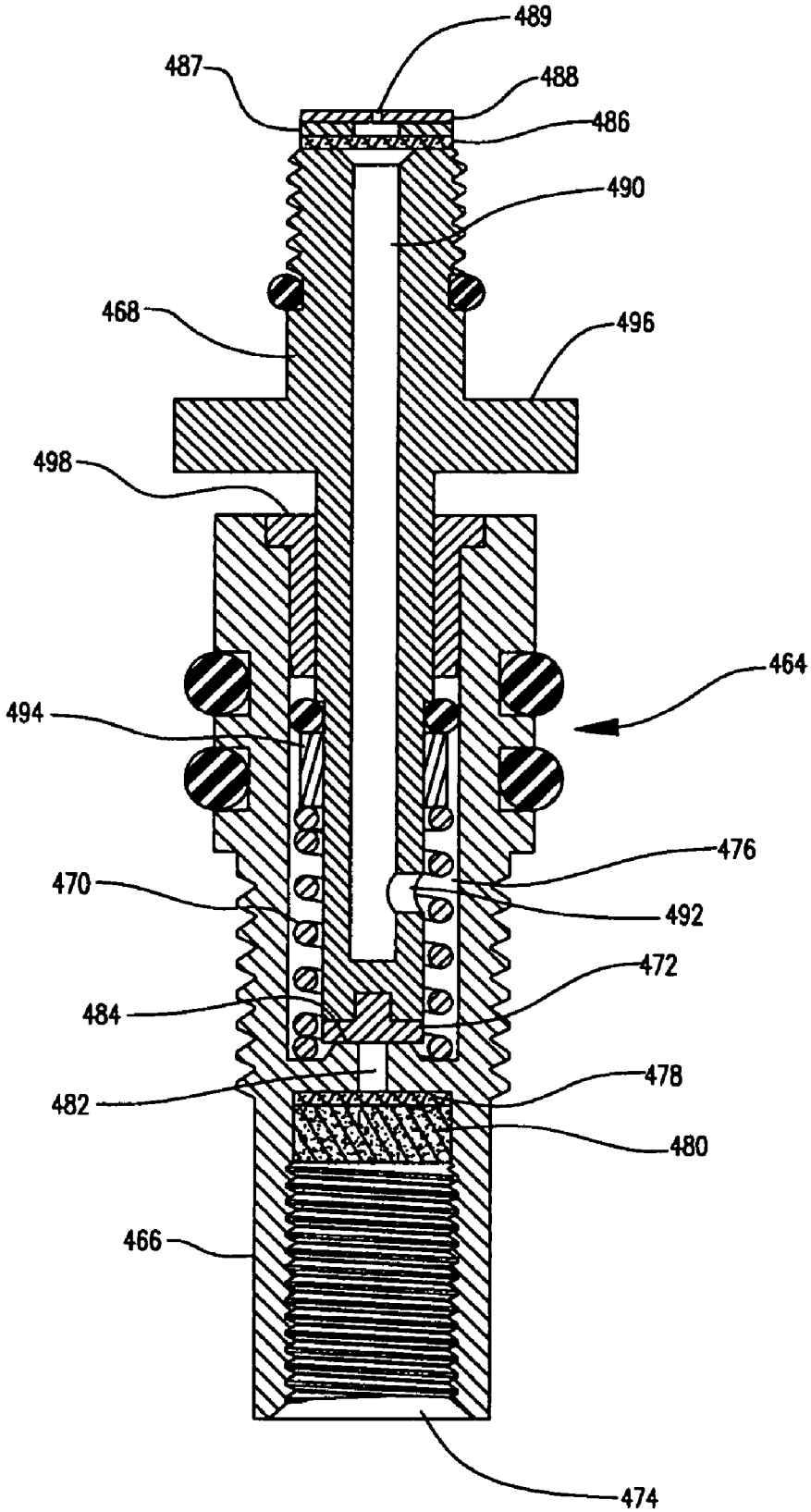
FIG. 25 is a cross sectional view of the main valve assembly.

A valve 16 is positioned at or near the top of the reservoir 12. the valve 16 communicates with a mixer 18 which in turn communicates with a nozzle (FIG. 9). Details of an appropriate valve are shown in FIG. 25. The valve 16 has an output orifice adapted to introduce a high velocity, low pressure jet of fuel into the mixer 18. This low pressure jet draws air into the mixer when the air inlet is open. The nozzle is surrounded by heat shield 22 which defines the sides of a combustion space above the nozzle. A cover 24 extends over the heat shield 22 and substantially, but not completely, closes the combustion space.

Figure 2:
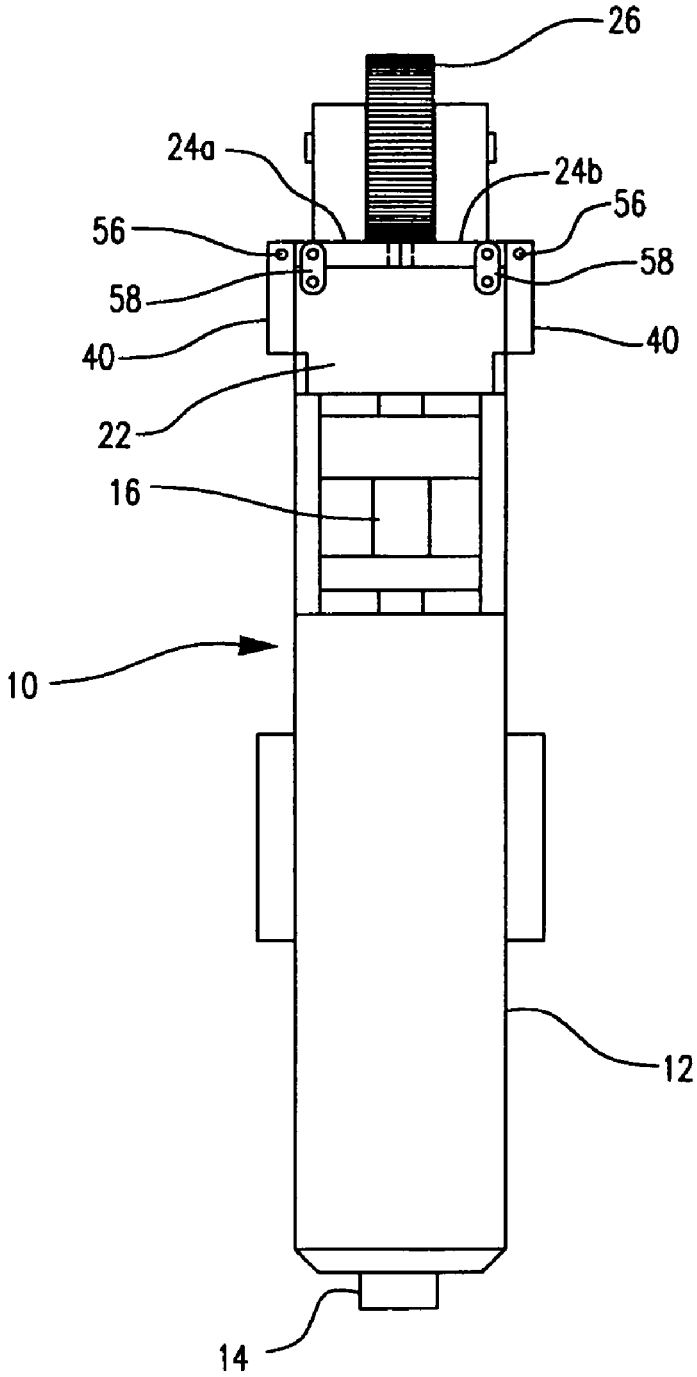
FIG. 2 is an end elevational view of the lighter of FIG. 1.

Still with reference to FIGS. 1 and 2, a striker wheel 26 is disposed at the top of the lighter 10. The striker wheel 26 has an outer cylindrical surface which has a file-like roughened configuration. A flint 28 (FIG. 3) is disposed below the striker wheel 26 in a flint containing column (not shown). The arrangement of the striker wheel 26 and the flint 28 is conventional with a spring in the flint 28 containing column biasing the flint 28 against the striker wheel 26 at a preselected pressure. The flint 28 is replaceable by removal of a bottom access screw which allows a user to pull out the biasing spring, replace a worn flint and replace the biasing spring. The operation of the flint and striker wheel is conventional. Flints are commercially available.

A thumb button 30 is positioned at the upper right hand corner of the lighter 10. The thumb button 30 is connected to a thumb button shank 32 which carries a rack 34. The rack 34 is a linear, vertical array of gear teeth rigidly fixed to the thumb button shank which moves up and down with the thumb button. A rotatable pinion gear 36 is mounted on a pin 38 fixed to the frame 40 of the lighter. The thumb button shank 32 is slidably fixed to the frame 40 by means of a dove tail or the like. The thumb button shank 32, thumb button 30 and associated rack 34 can slide upwardly and downwardly with respect to the frame but are held laterally in place with respect to the frame 40 such that the rack 34 is always in engagement with the pinion gear 36. A spring 42 (FIG. 3 only) biases the thumb button upwardly when it is not being manually depressed.

A lifter 44 is rigidly fixed to a second rack 46. The lifter 44 has a vertical shank portion 48, a lower lateral portion 50 and an upper lateral portion 52. The lifter shank portion 48 slidably engages the lighter frame 40 by means of a dove tail or the like. The lifter 44 can move vertically with respect to the lighter frame 40 but is laterally fixed with respect to the lighter frame 40. The lifter rack 46 engages the pinion gear 36. Because of this, when the thumb button shank 32 is displaced downwardly, the lifter shank 48 is displaced upwardly an equal distance.

Referring now to FIG. 2, one sees the cover 24 is split down its center into two cover halves 24A, 24B in this embodiment. The cover halves are generally rectangular with their outboard edges hinged to the frame 40 by means of cover hinge pins 56. The cover halves 24A, 24B are each individually fixed to the heat shield 22 by means of links 58. The links 58 are fixed at their lower ends to the heat shield 22 by means of pins and at their upper ends to the cover halves 24A, 24B by pins. When the heat shield 22 moves upwardly with respect to the frame 40, the links 58 will push upwardly on the cover halves 24A, 24B causing them to rotate upwardly around the cover hinge pins 56, thus opening the top of the combustion space within the heat shield 22.

Figure 3:
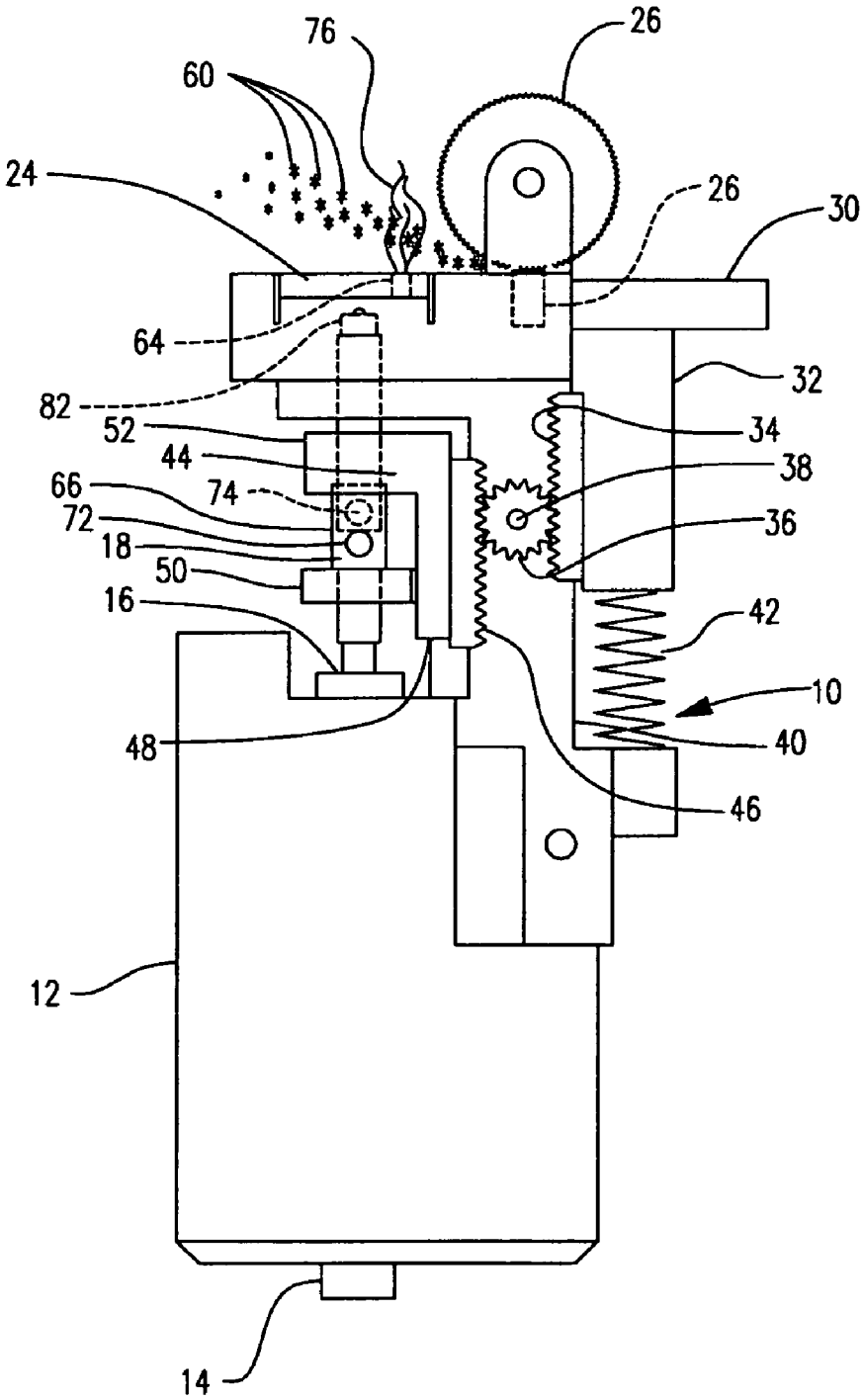
FIG. 3 is a side elevational view of the lighter of FIG. 1 just after the wheel of the lighter has been rotated and as the actuator is started to be depressed.
Figure 4:
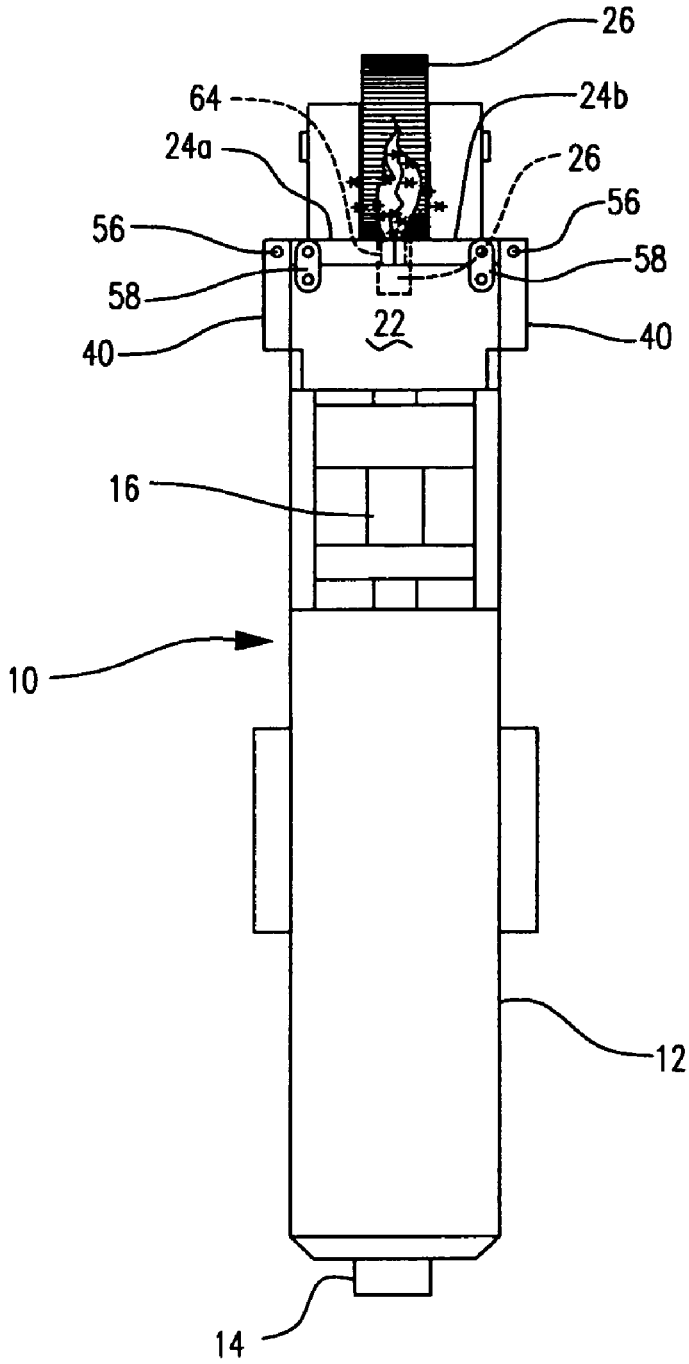
FIG. 4 is an end view of the lighter of FIGS. 1-3 in the configuration of FIG. 3.
Figure 5:
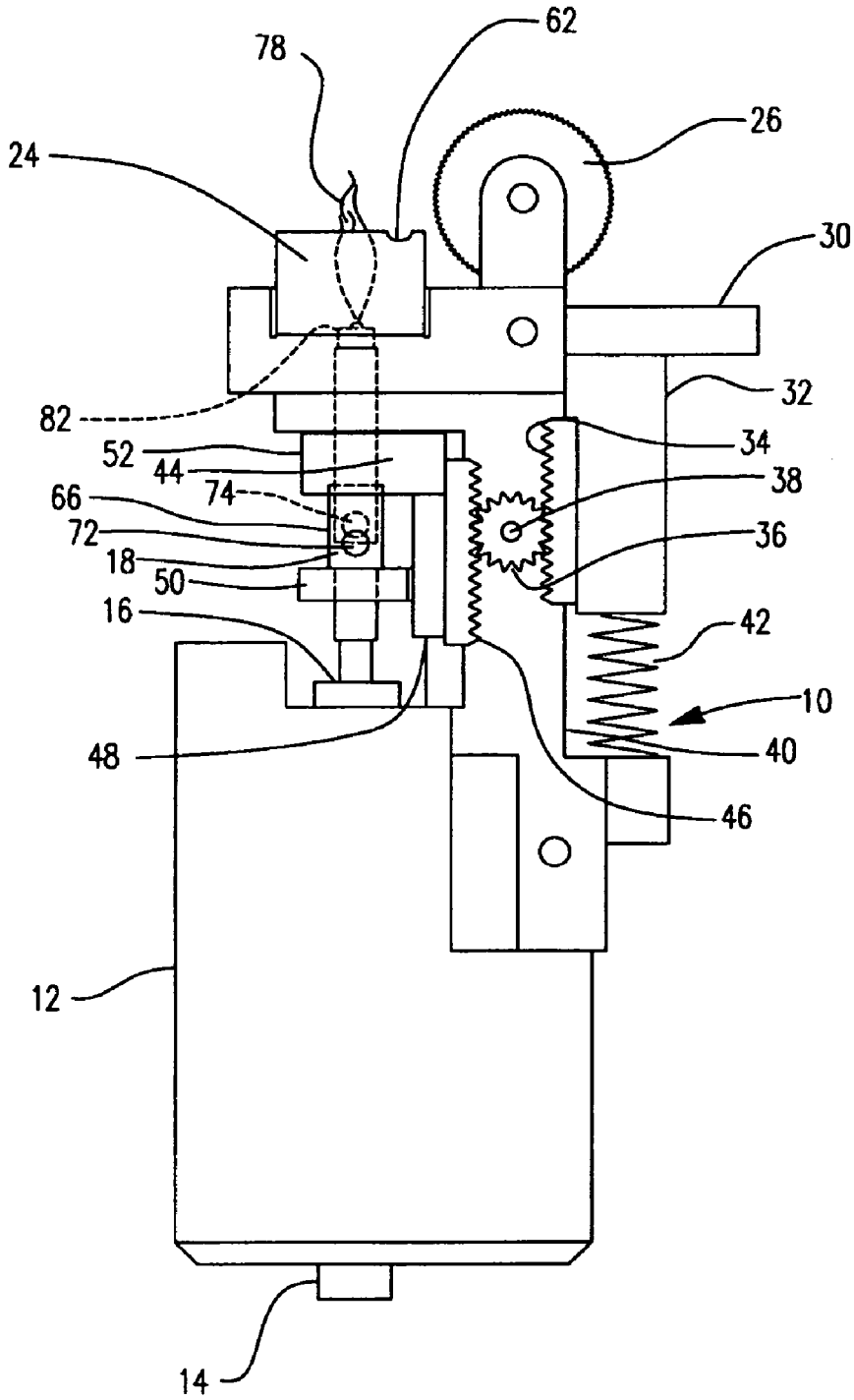
FIG. 5 is a side elevational view similar to FIGS. 1 and 3 showing the actuator further depressed and the combustion space top cover partially opened.
Figure 6:
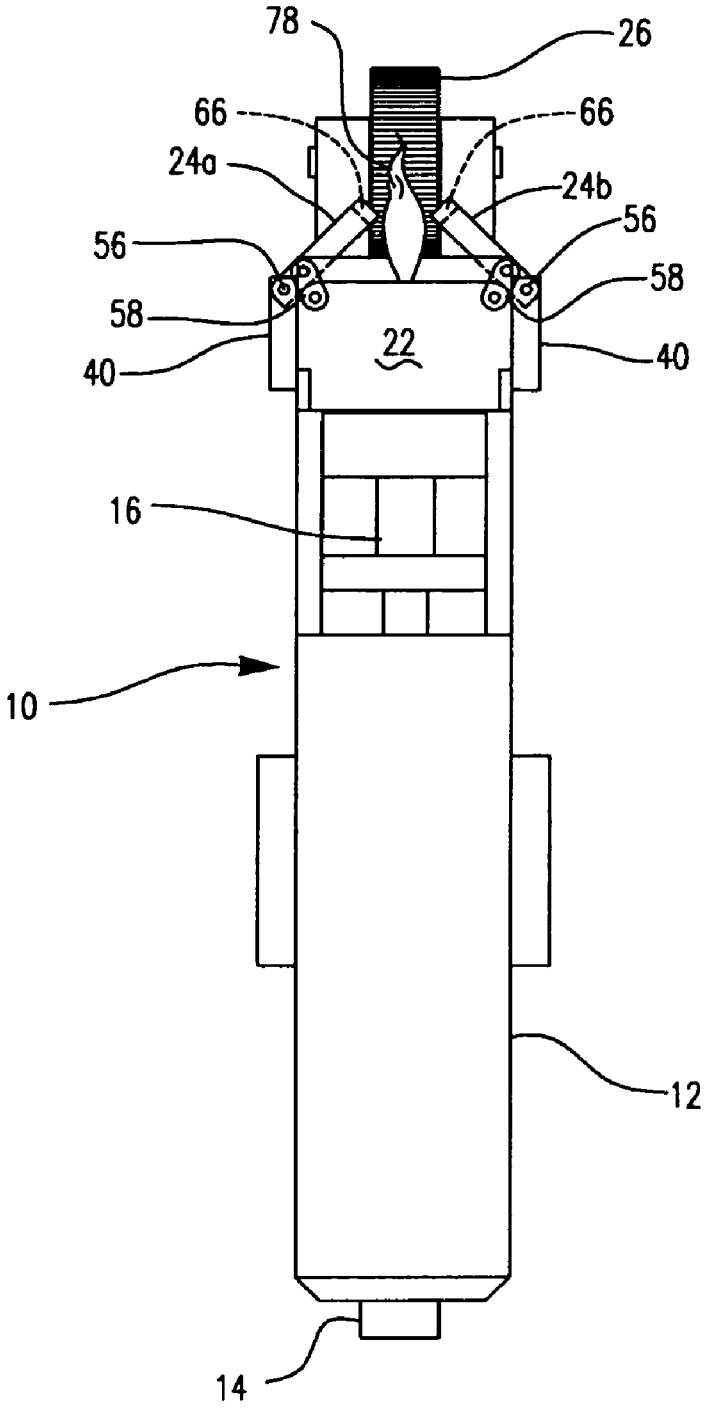
FIG. 6 is a an end view of the lighter of FIGS. 1-5 in the state illustrated in FIG. 5.
Figure 7:
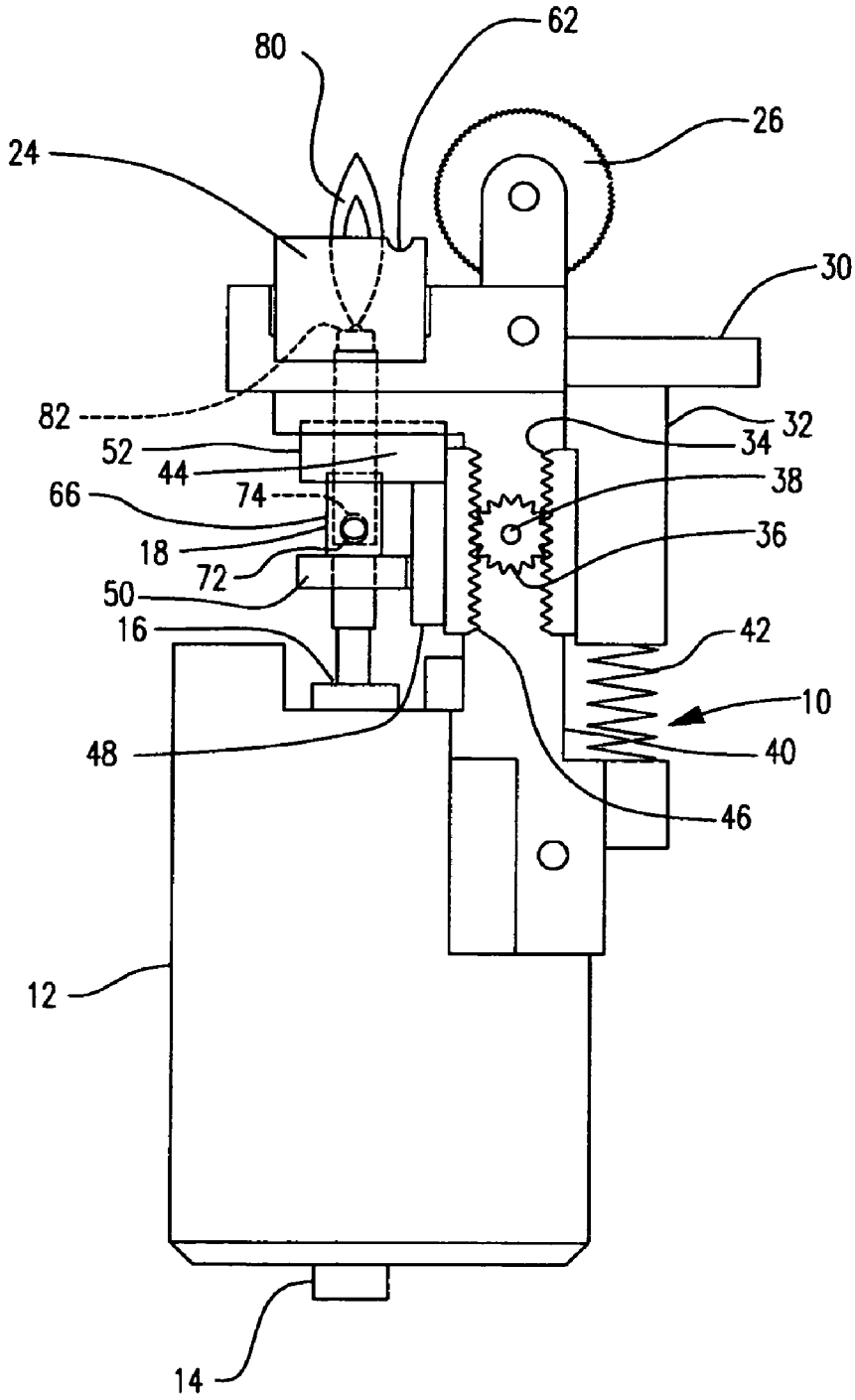
FIG. 7 is a side elevational view similar to FIGS. 1, 3 and 5 showing the rack and pinion further extended and the top cover fully opened.
Figure 8:
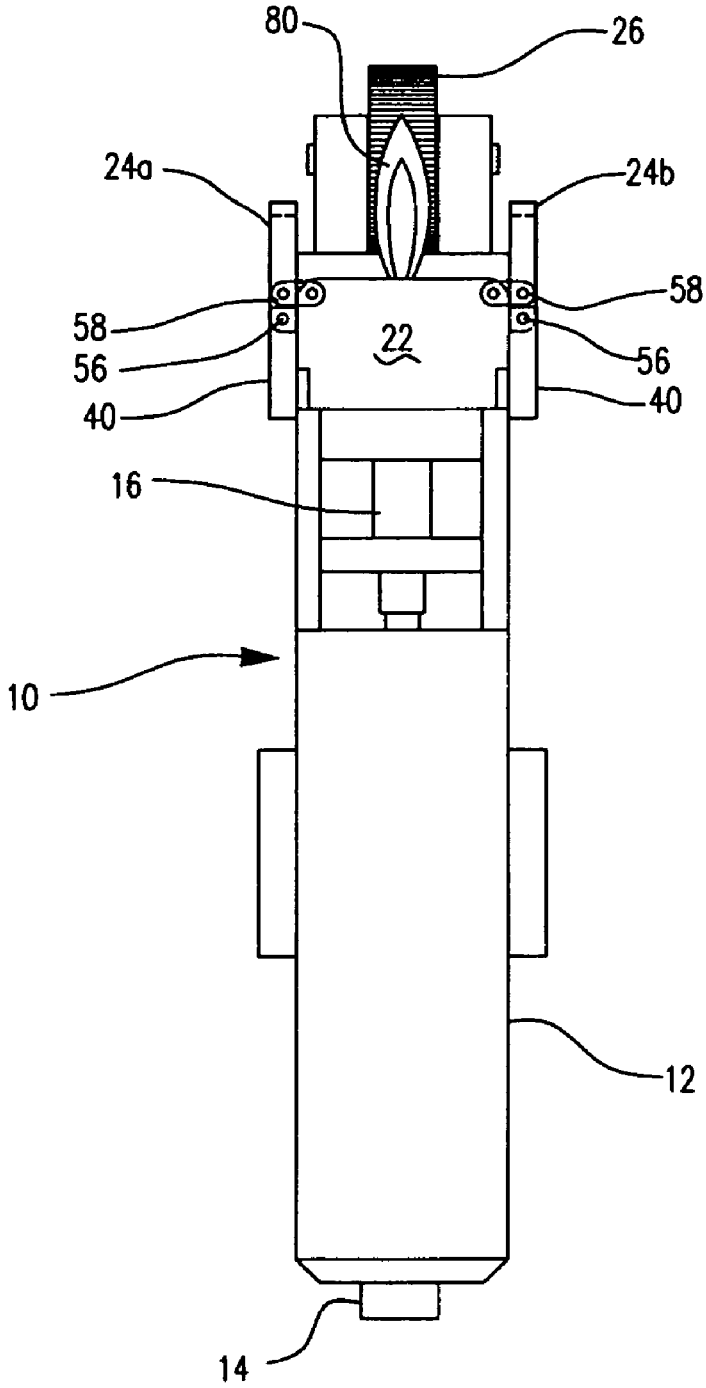
FIG. 8 is a end view of the lighter of FIGS. 1-7 in the same state as FIG. 7.

The operation of the lighter is illustrated as a sequence of paired figures, FIGS. 1 and 2; FIGS. 3 and 4; FIGS. 5 and 6; FIGS. 7 and 8; and FIGS. 9 and 10. Additionally, the sequence of operations is described in the flow chart of FIG. 14. It must be appreciated, that the operational sequence starts from an initial rest position seen in FIGS. 1 and 2 and proceeds through a continuous movement of elements to the fully opened operating position seen in FIGS. 9 and 10.

Referring again to FIGS. 1 and 2, the lighter is seen in a rest position. The main valve 16 is closed thus no fuel gas is flowing through the main valve 16 or the mixer 18. The thumb button 30 is at its fully upwardly extended position. The combustion space cover 24 is closed. When an operator wishes to ignite the lighter, the operator proceeds with actuation similar to a conventional flint and wheel equipped lighter. The operator rotates the striker wheel 26 causing the striker wheel to abrade the flint and propel a body of incandescent sparks 60 (FIG. 3) over the top of the closed combustion space covers 24A, 24B. The cover halves 24A and 24B each have semicircular cutouts on their inboard edges facing one another. These cutouts 62, one of which is seen in FIG. 5, create a circular hole 64 shown with dashed lines in FIGS. 2 and 4. Referring now to FIG. 3, the user's thumb slides off the striker wheel 26 and engages the thumb button 30 depressing the thumb button causing the rack and pinion arrangement to raise the lifter 44. The upward movement of the lifter 44 opens the gas valve 16 causing high pressure gas from the reservoir 12 to immediately flow through the mixer 18, the nozzle, the combustion space and out through the hole 64. Because incandescent sparks are traversing the top of the hole 64, a gas flame 76 is ignited just above the hole 64. The incandescent spark material travels across the top of the combustion space and ignites the flame 76 while the cover halves 24A and 24B are closed. Debris and exhausted spark material is kept away from the nozzle and other burner components. As seen in FIG. 3, the mixer 18 includes a choke. In this embodiment, the choke consists of an outer hole 72 in an outer sleeve and an inner hole 74 in the tube carrying the fuel gas. As seen in FIGS. 1 and 3, the two holes are not aligned when the thumb button 30 is not depressed or just starting to be depressed. Therefore, the choke is closed and air is not admitted to the mixer 18. In the state seen in FIG. 3, the gas valve 16 is opened and gas is flowing through the mixer 18, nozzle and combustion space but no air is admitted through the choke hole 72. Thus the flame 76 is a post mix flame. That is, air is added to the fuel gas at the location of combustion, not upstream from the location of combustion. Post mix flames are easily ignited by incandescent sparks from flints.

Referring now to FIGS. 5 and 6, one sees the lighter further in the process of being operated. The thumb button 30 has been further depressed and the lifter 44 is further elevated. The lower lateral portion 50 of the lifter 44 has engaged the bottom of the choke sleeve 66 and pushed it upwardly allowing the choke sleeve outer hole 64 to be partially in registry with the inner hole 72. This allows some air to enter the mixer 18 where it is entrained with the fuel gas and mixed therewith.

The upper lateral portion 52 of the lifter 44 has also engaged the heat shield 22 pushing it upwardly. As the heat shield 22 moves upwardly, the links 58 open the cover 24. As seen in FIGS. 5 and 6, the cover is partially opened and the flame, now a rich premix flame 78, has migrated from the hole 62 into the combustion space surrounded by the heat shield 22.

In FIGS. 7 and 8, one sees the thumb button 30 further depressed thus elevating the lifter 44 further. The choke sleeve 66 has been raised so that the two choke holes 72, 74 are in near perfect alignment operating as an air inlet and the two cover halves 24A, 24B are in the vertical position. The holes in the choke are sized to allow entry of sufficient air to create a strong premix, torch-like flame 80 within the heat shield 22 and extending above the heat shield 22. The low pressure jet of fuel gas draws air through the choke by a venturi effect. A premix flame 80 is much more forceful and organized than a post mix flame as is seen in FIG. 3. A premix flame can be directed in orientations other than straight up and substantially hold its shape. Premixed flames are visually characterized by a central core having a light blue color surrounded by a darker blue flame portion. Premix flames are stronger and hotter than post mix flames and more easily directed to ignite a pipe or cigar than a post mix flame.

Figure 10:
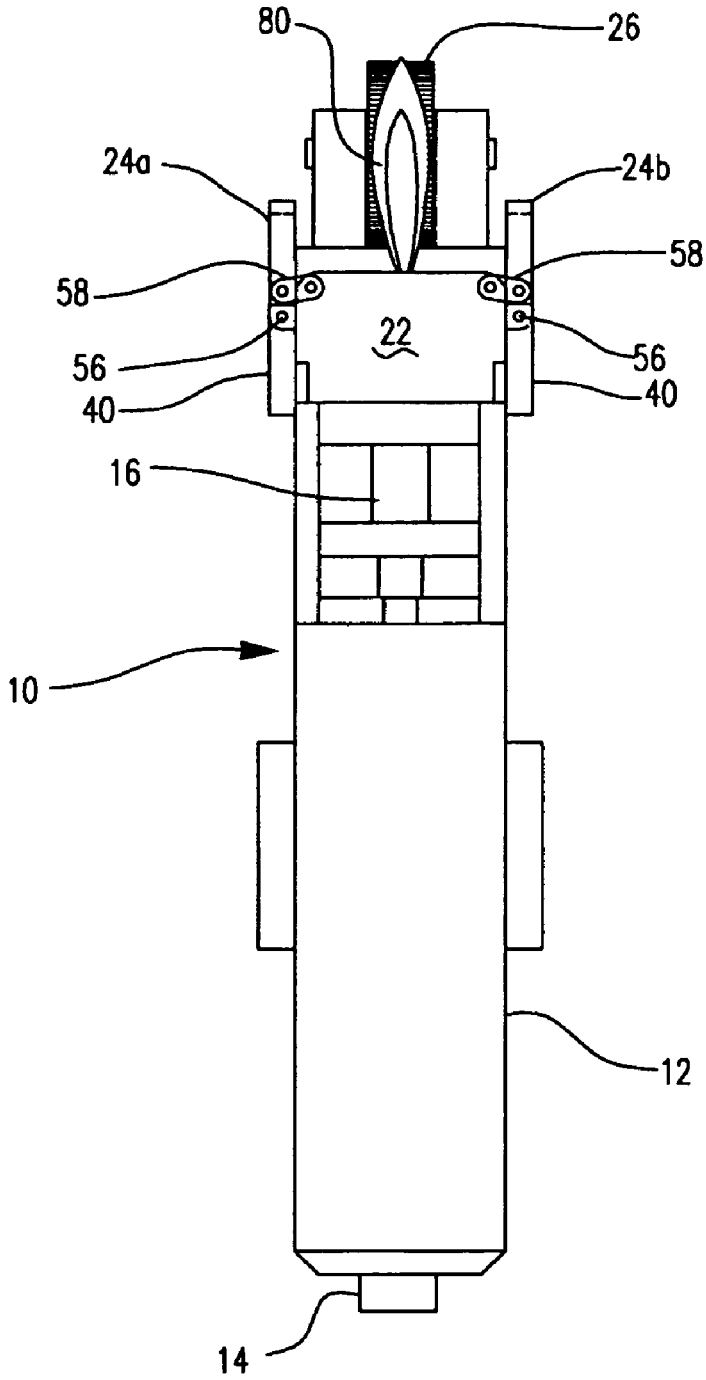
FIG. 10 is an end view of the lighter of FIGS. 1-9 in the same state as FIG. 9.

FIGS. 9 and 10 show the thumb switch 30 fully depressed and the lifter 44 fully extended upwardly. The two holes of the choke, 72, 74 remain aligned so that air is drawn into the mixer 18. The heat shield 22 is fully extended upwardly as is the nozzle 82 positioned at the bottom of the heat shield 22. The premix torch like flame 80 extends somewhat higher over the top of the lighter 10 as the nozzle is higher. A forceful, directed premix torch like flame 80 is provided so long as the thumb button 30 remains depressed. When the user is finished with the lighter, the thumb button 30 is released and the spring (FIG. 3) quickly pushes the thumb button upwardly which, through the actions of the rack and pinion, lowers the lifter 44 into the position seen in FIG. 1. This quickly closes the top cover halves 24A, 24B and almost simultaneously closes the choke and the fuel valve 16. The flame is extinguished.

Figure 11:
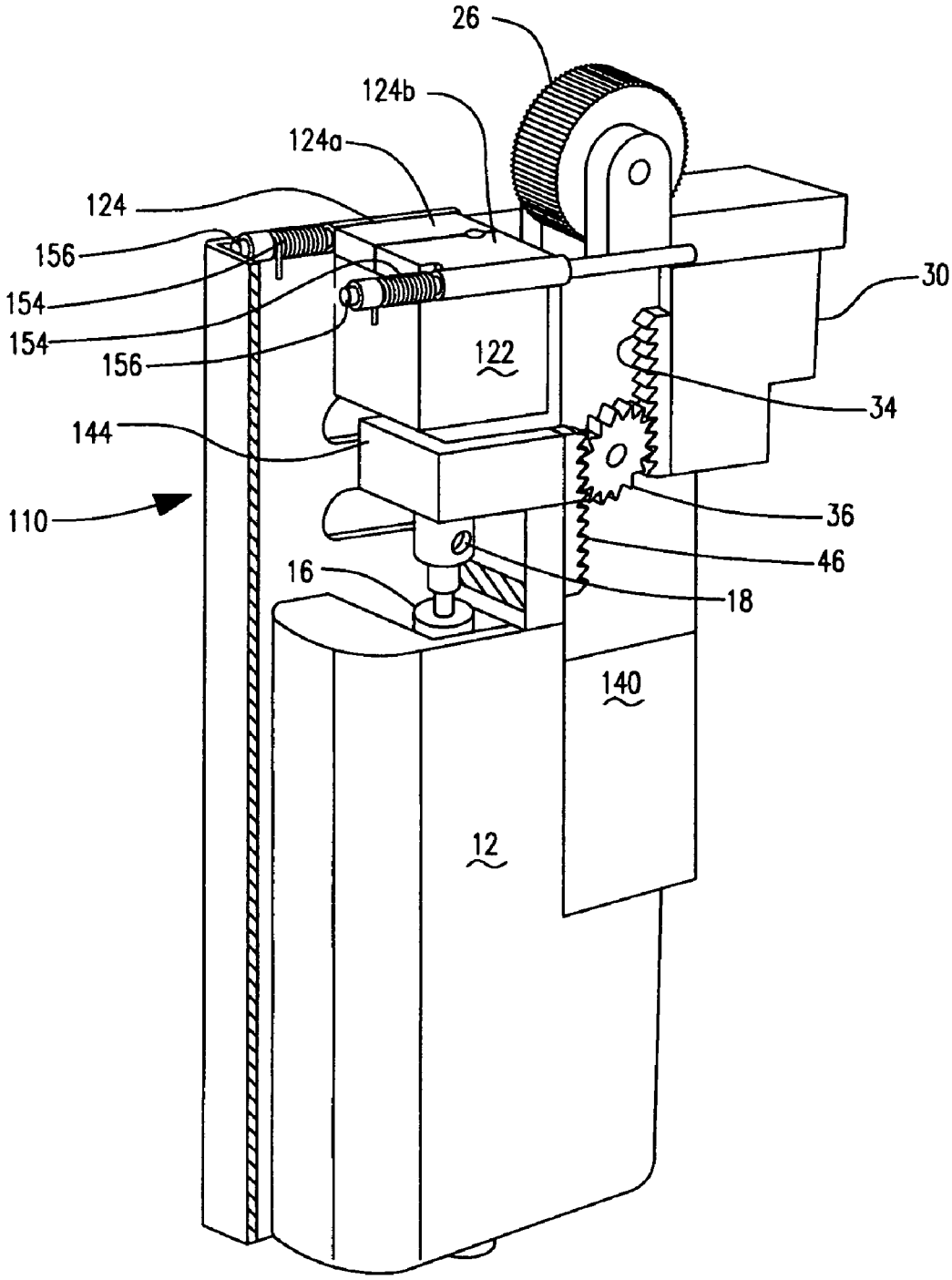
FIG. 11 is a perspective view of an alternate embodiment of a lighter in accordance with this invention having a different top cover opening mechanism.

FIG. 11 shows a second embodiment of the lighter 110 partially cut away. The thumb button 30 drives a rack and pinion arrangement identical to that seen in the first embodiment. A lifter 144 identical to that seen in the first embodiment is used in this embodiment. However, in FIG. 11, the lower lateral portion of the lifter is cut away to provide greater clarity. The difference between the embodiment of FIG. 11 when compared to the embodiment of FIGS. 1-10 is solely in the cover 124. Two cover halves 124A, 124B are provided. As in the first embodiment, the cover halves are fixed to the side walls of the frame 140 by means of pins 156. The pins are provided with springs 154 which bias the cover halves into the closed position. In the first embodiment, the cover halves 24A and 24B are opened and closed by actions of the links 58. In this embodiment, links are not provided. Rather, the heat shield 122 opens the cover halves 124A and 124B by pushing upwardly on their bottom surface against the pressure of the springs 154. At the end of use of the lighter, rather than the links 58 pulling the covers down, the springs 154 urge the covers to rotate to the closed position as the heat shield 122 is retracted.

Figure 13:
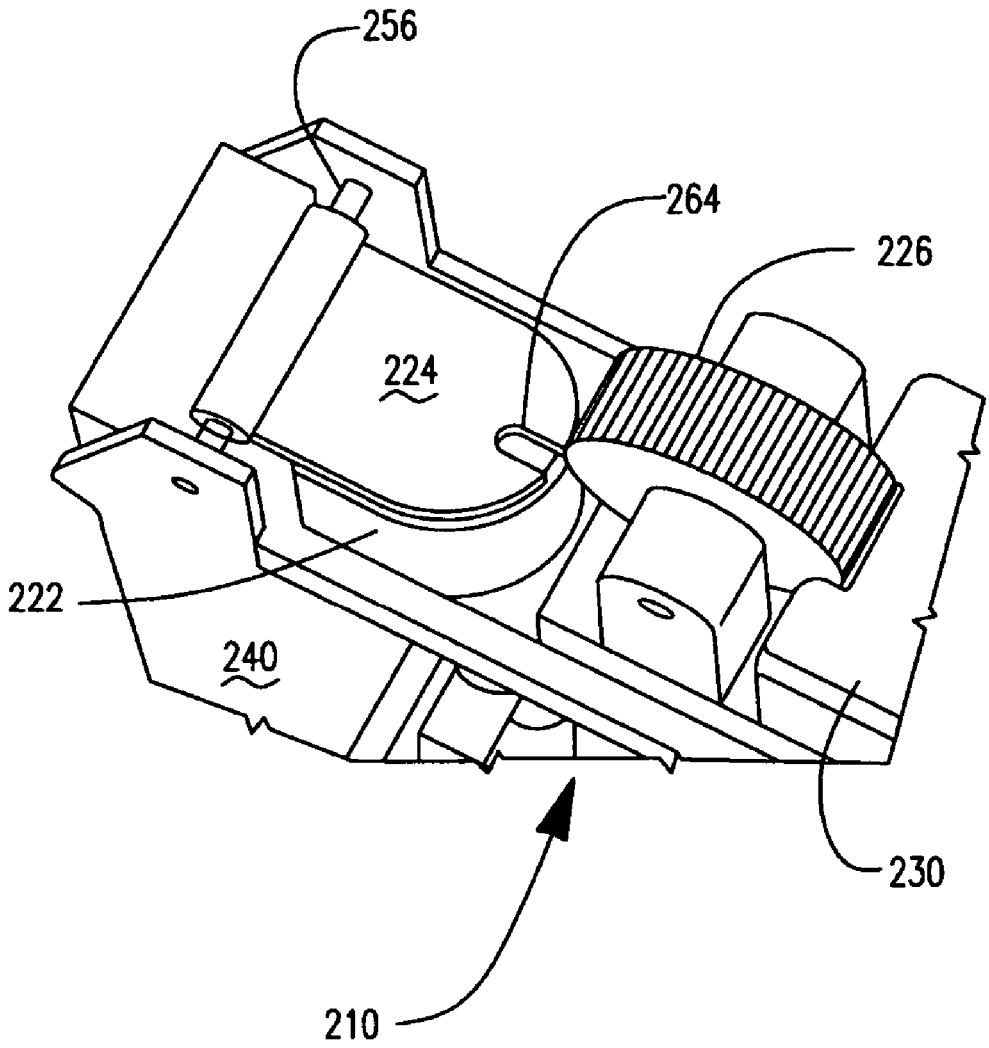
FIG. 13 is a downwardly looking perspective of another embodiment similar to the embodiment of FIG. 12.

A third embodiment of the invention is shown in FIG. 13. The lighter 210 operates in a manner similar to the first embodiment except that the cover 24 is comprised of a single door 224 hinged on a pin 256. The pin 256 is fixed on both of its ends to the side walls of the frame 240. Springs (not shown) bias the cover 224 in the closed position. The operation of the third embodiment is similar to the operation of the second embodiment in that downward pressure on the thumb button 230 operates a mechanism raising the heat shield 222 surrounding the combustion space. The operating mechanism can be either a series of levers or a rack and pinion as described above. The heat shield 222 engages against the underside of the cover 224 rotating the cover into a vertical position opening the top of the combustion space within the heat shield 224. As can best be seen in FIG. 13, the cover 222 is provided with a hole 264 allowing creation of a post mix gas flow into the area into which sparks are injected by operation of the striker wheel 226. Thus, the various stages of operation of the lighter 210 are identical to the stages described with references to FIGS. 1-10.

Figure 12:
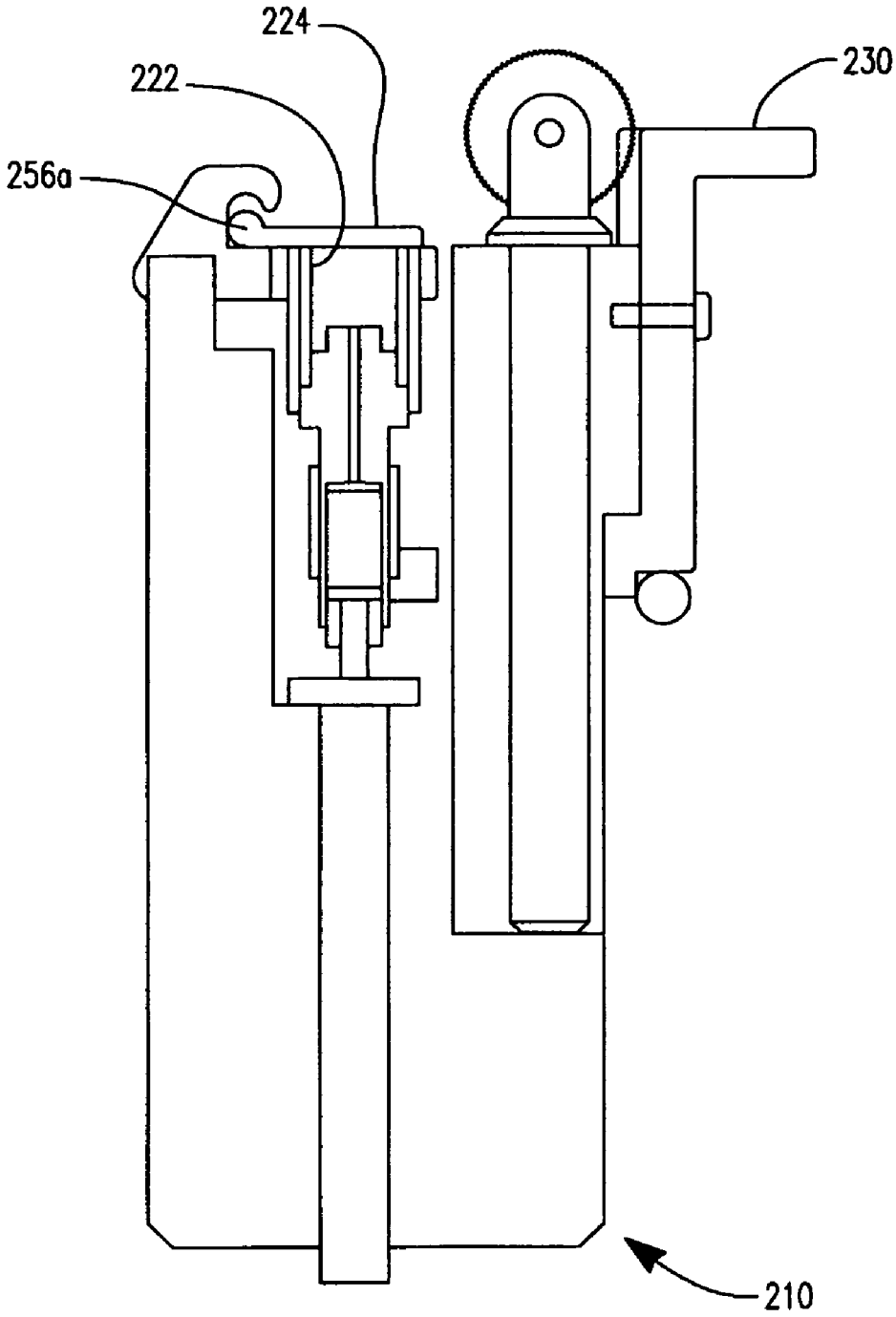
FIG. 12 is a side elevational view, partially cut away, of another alternate embodiment of a lighter in accordance with the present invention having a different combustion space top cover.

The embodiment shown in FIG. 12 is identical to the embodiment shown in FIG. 13 except the single door 224 is provided with an integral pin 256*a* extending from both sides of the door 224 and engaging recesses in the frame sidewall.

The structure as described with respect to the preferred embodiments all use nozzles having at least one central opening and surrounding stabilization openings. Such an arrangement is conventional with respect to a premix torch flame type lighter. Other nozzles as are conventionally used to produce premix flames could also be used without changing the overall structure of the preferred embodiments. An adjustment mechanism metering the amount of gas passing through the valve 16 can also be used. All of the structures described provide a door which protects the nozzle from spark debris and allows creation of a post mix flame above the door prior to opening; and, transitioning the flame to a premix flame within a combustion space as and after the door opens in operation of the lighter. This structure and operation of this structure results in protection of the nozzle from flint spark debris and reliable ignition of a flame which transitions into a premix directable flame.

Figure 14:
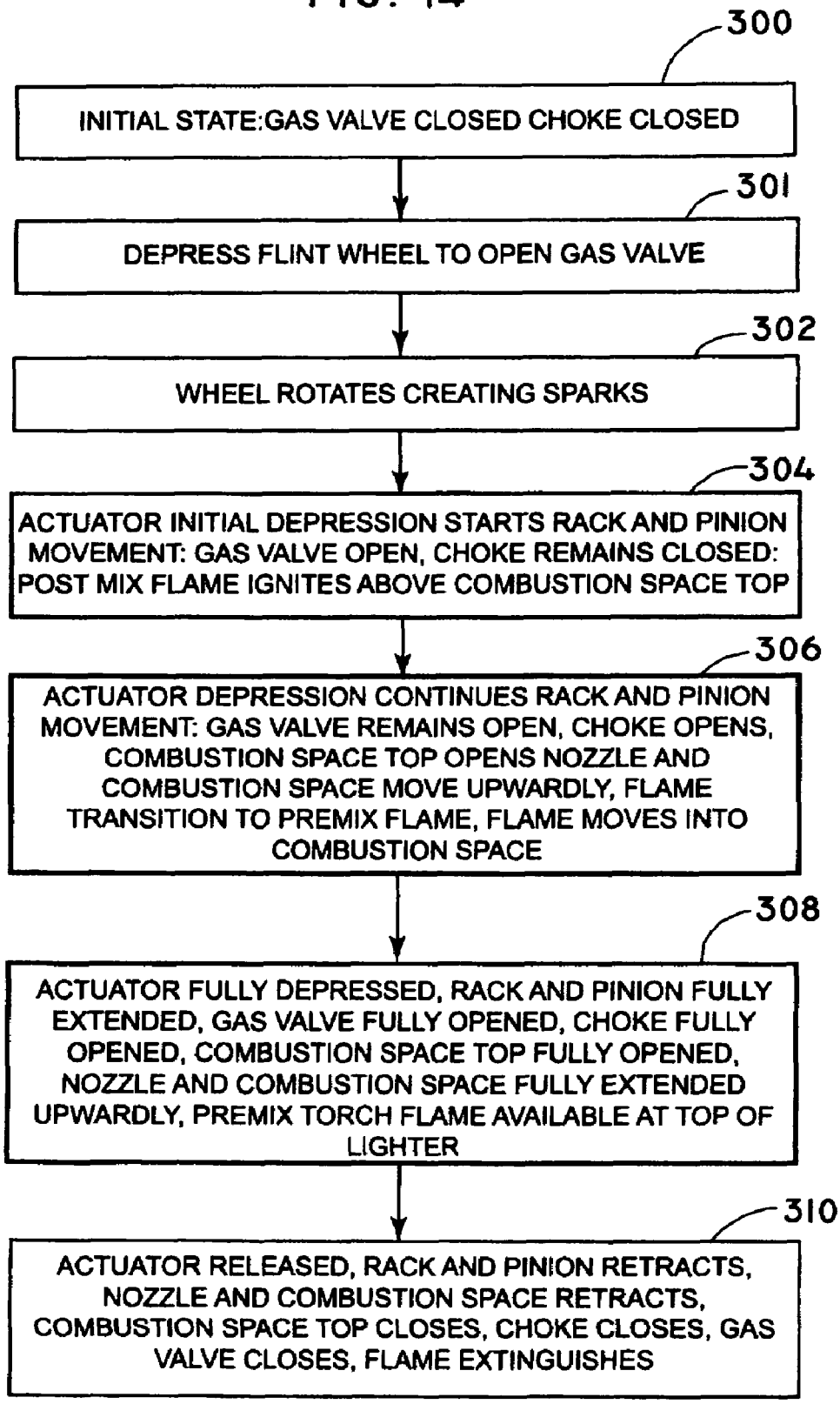
FIG. 14 is a flow diagram showing the steps in the operation of a lighter in accordance with the present invention.
Figure 15:
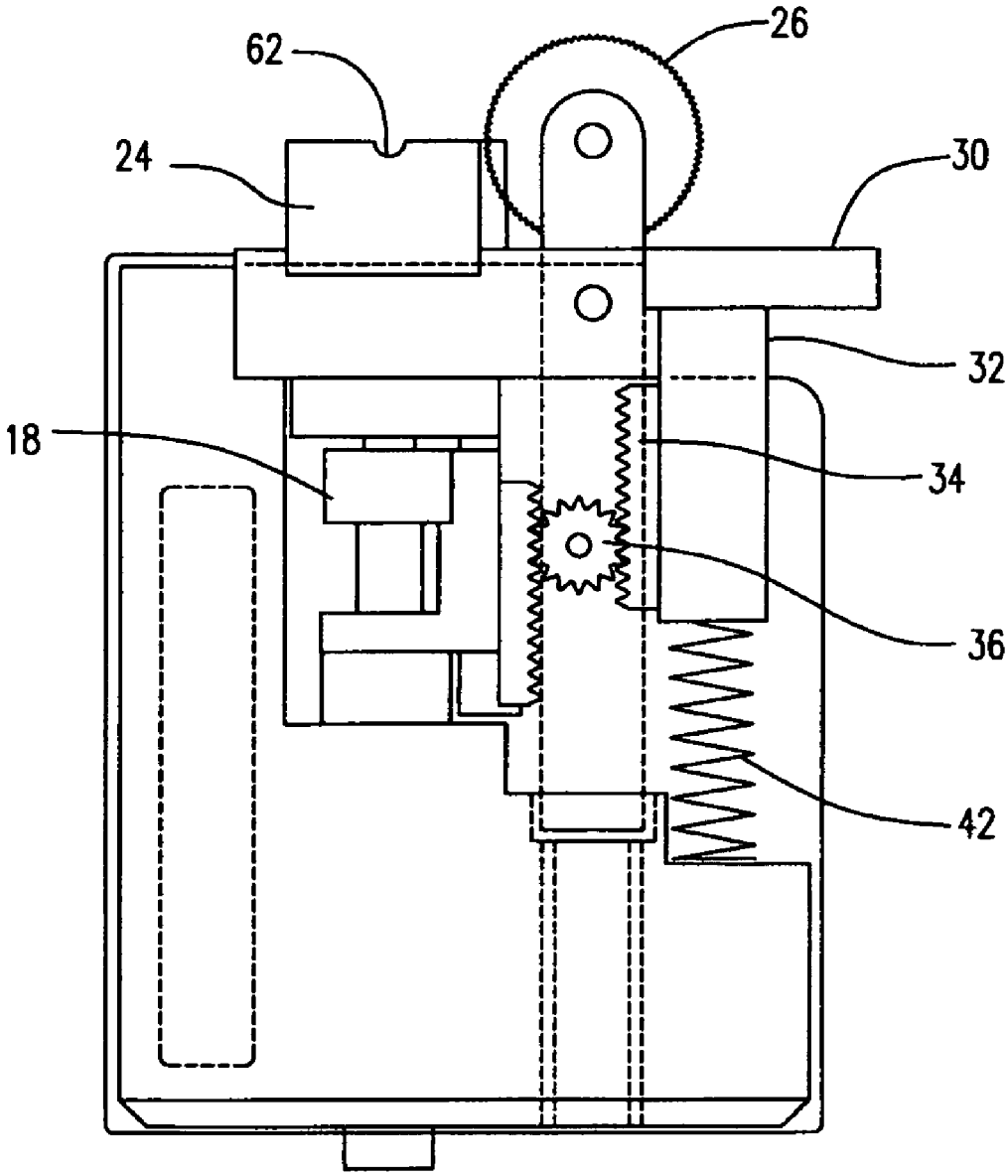
FIG. 15 is a schematic side elevation of the embodiment seen in FIGS. 1-10, partially cut away, showing the relationship of the assembled main components.

The method of operating the lighters illustrated in FIGS. 1-13 is stated in block diagram flow chart form in FIG. 14. The steps set forth are not broken up in a manner identical to those seen in FIGS. 1-10 but describe the same process as the illustrations. In the initial state 300, corresponding to FIGS. 1 and 2, the gas valve 16 is closed and the lighter is in the storage position. An operator starts use of the lighter in a first actuation step 301 in which the operator depresses the flint or striker wheel 26 to open the gas valve. In step 302 the operator rotates the striker wheel 26. Actuation continues in step 304 in which the thumb button 30 is depressed by the thumb of the user which continues movement of the rack and pinion. The thumb button depresses, continuing movement of lifter and maintaining the gas valve open. The open gas valve allows the flow of gas through the lighter and out the hole 64 resulting in the ignition of a post mix flame 76. The state of the lighter after the actuation step 304 is seen in FIGS. 3 and 4.

The lighter continues into step 306 in which continued downward movement of the thumb button 30 results in continued upward movement of the lifter 44 which partially opens the choke and partially opens the top over the combustion space. This starts the transition of the flame into a premix flame and moves the flame into the combustion space. The state of the lighter during this step 306 is shown in FIGS. 5 and 6 and the state of the lighter at the end of the step 306 is shown in FIGS. 7 and 8.

A final actuation step is achieved when the thumb button 30 is fully depressed resulting in the lifter 44 being fully extended upwardly. This fully opens the choke and fully extends the combustion space within the heat shield 22 upwardly out of the top of the lighter. A premix torch-like flame is now available at the top of the lighter. The state of the lighter during this final actuation step 308 is illustrated in FIGS. 9 and 10.

A release state 310 is initiated by a user releasing the thumb button 30 by removing the operator's thumb. The thumb button or actuator is then spring driven in an upward direction causing the lifter 44 to rapidly move to its downward rest state which closes the combustion space top, retracts the heat shield, closes the choke and closes the fuel valve extinguishing the flame. The lighter is now ready for storage or for its next use.

Figure 16:
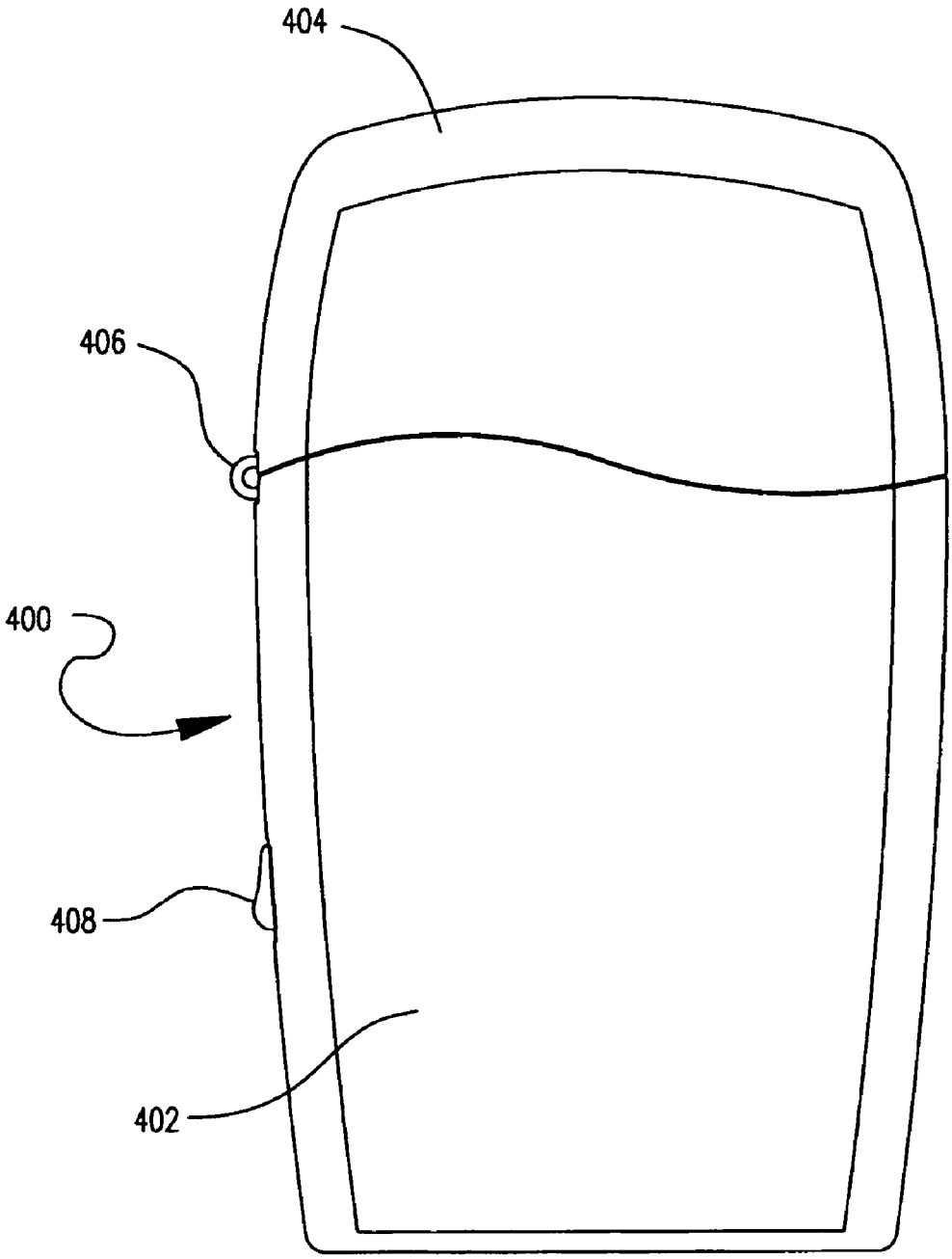
FIG. 16 is a front view of another embodiment of the invention.

Another embodiment of the invention is shown in FIGS. 16-24. FIG. 16 shows the lighter 400 in its case 402 with the case lid 404 in the closed position. The case lid 404 is joined to the case 402 by means of a hinge pin 406 as is conventional. A valve release interlock button 408 may optionally be included, and, if so, protrudes slightly from the lower left of the lighter case 402.

Figure 17:
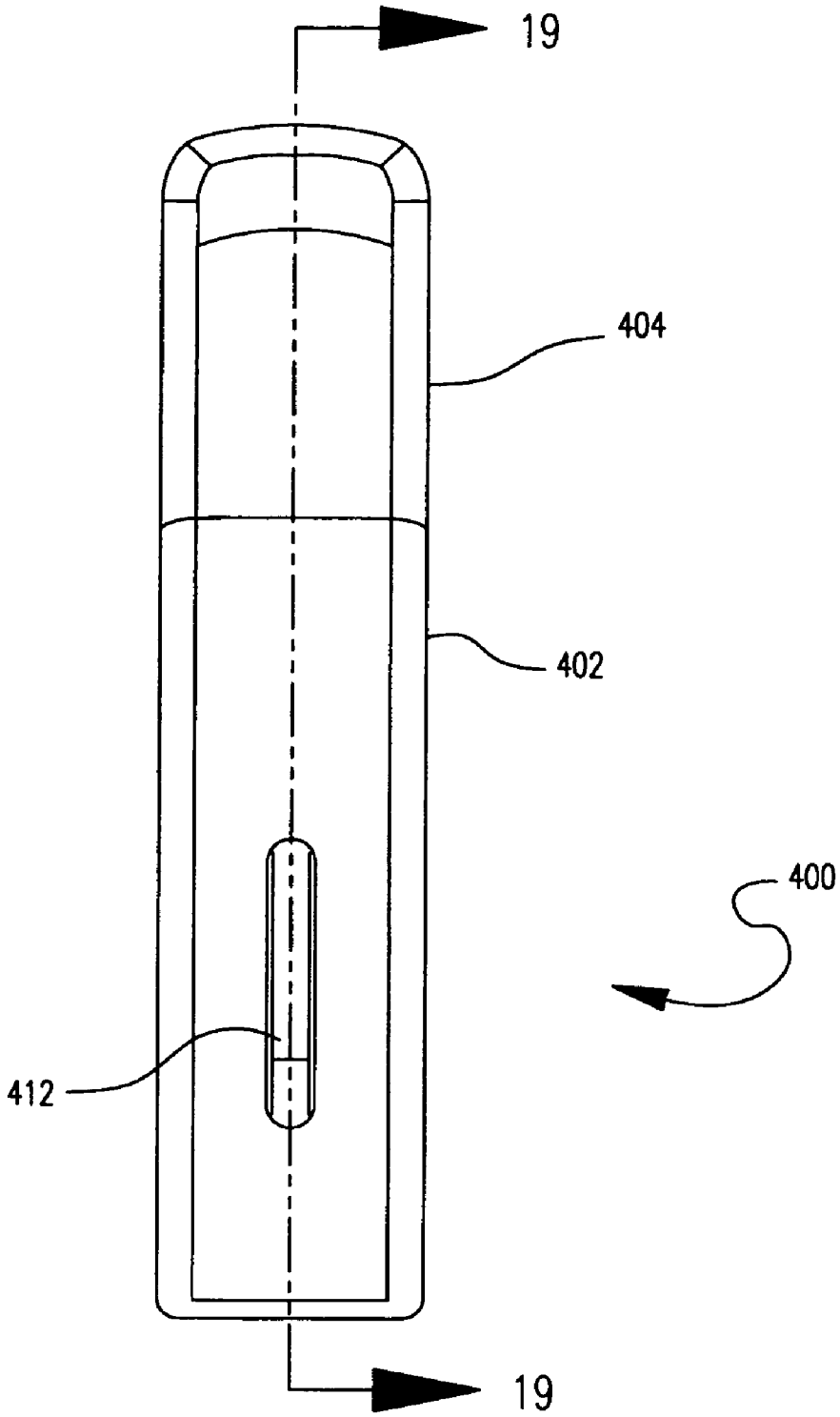
FIG. 17 is a side view of the embodiment of FIG. 16.

With reference to FIG. 17, a fuel level window 412 in the case 402 allows the user to see the level of butane fuel in the lighter 400.

Figure 18:
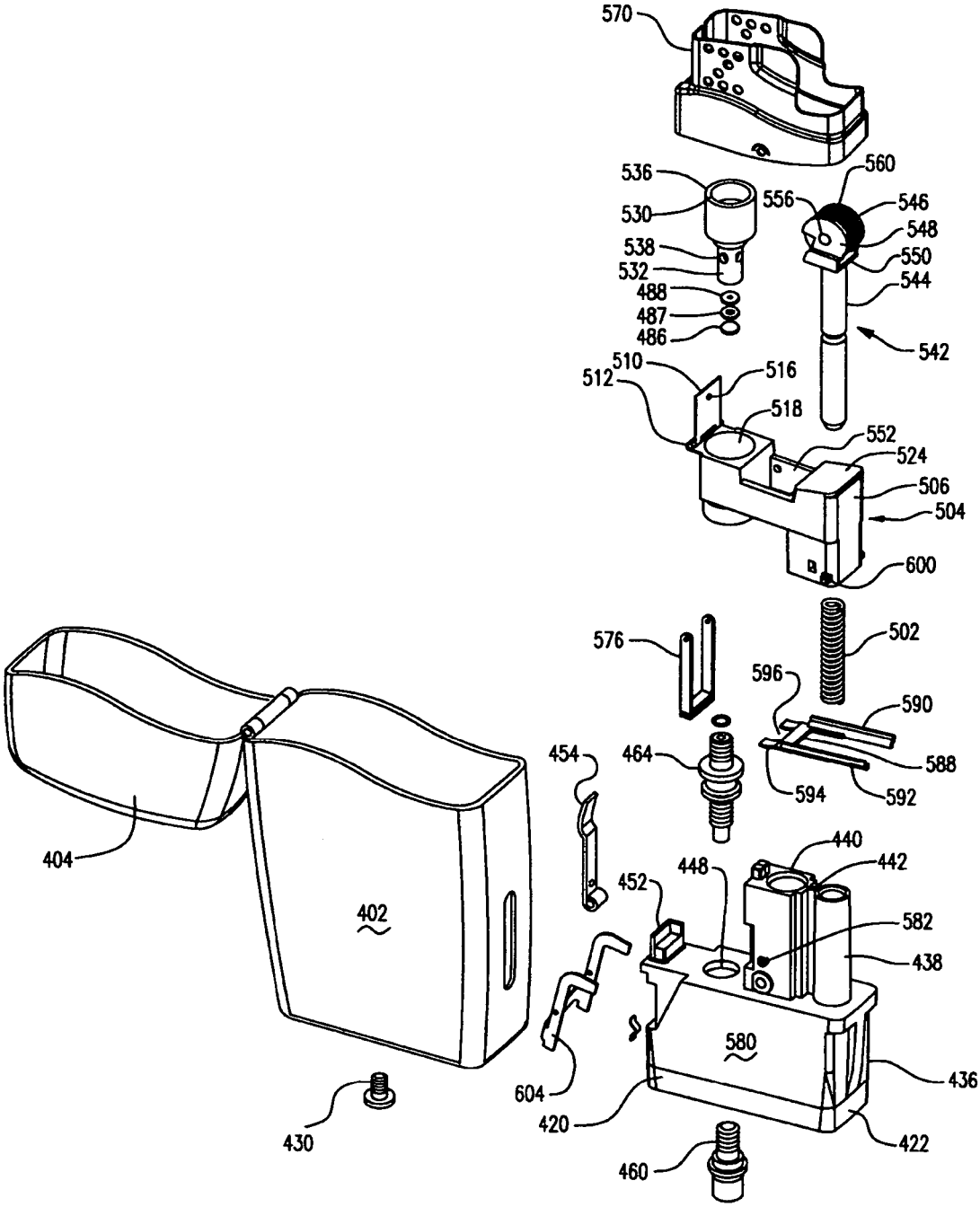
FIG. 18 is an exploded view of the parts and assemblies of the lights of FIGS. 16 and 17.
Figure 19:
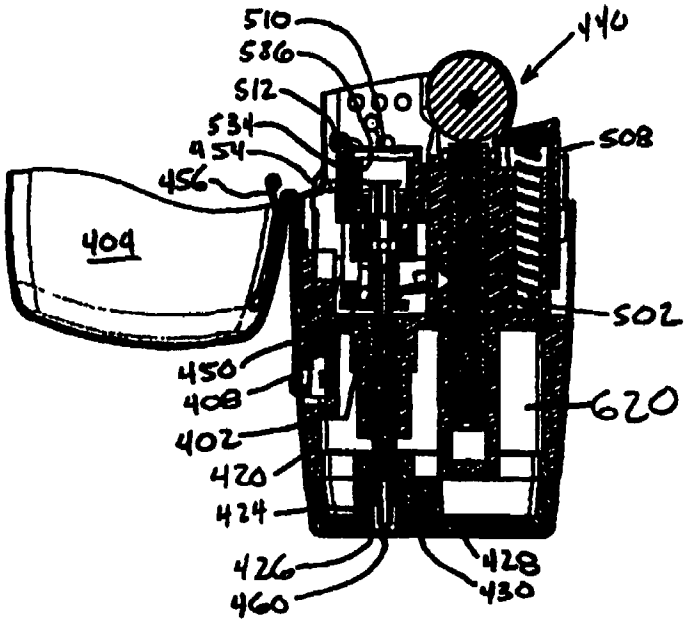
FIG. 19 is a vertical sectional view taken along line 19-19 of FIG. 17 with the case opened.

With reference to FIG. 18, the lighter 400 is comprised of a number of parts and assemblies. A frame 420 is preferably fabricated in two parts of nylon 6/T or other similar plastic material adapted for containing butane, being sonically welded and being precisely formed. The frame lower half 422 has a through hole 424 opening into a fill valve retaining rube in its bottom which will be in registry with a similar through hole 426 in the case 402 (FIG. 19). The frame lower half 422 also has a blind hole 428 accommodating a screw 430 used to fix the frame 420 to the case 402.

The frame upper 436 has a bottom which mates with and is sonically welded to the top of the frame lower half 422. The top of the frame upper half 436 is generally planar with several towers extending therefrom. A main spring retaining tower 438 extends upwardly from one side of the top of the frame 420. Adjacent the main spring retaining tower is a flint and wheel igniter retaining tower 440. The igniter retaining tower 440 has a vertically orientated central internal tube. The external surfaces of the igniter retaining tower 440 are generally planar but also support functional elements to be hereinafter described. The main spring retaining tower 438 and the igniter retaining tower 440 are interconnected by a web 442 which stiffens both structures.

Moving to the left, adjacent the igniter retainer tower 440, the top of the frame 420 is provided with a through hole 448 opening into an interiorly directed valve retaining tube 450. (FIG. 19). Adjacent the through hole 448 is a case spring retaining tower 452. A case spring 454 is retained in a slot in the case spring retaining tower 452 and extends vertically adjacent the side of the case to appoint adjacent the case hinge pin 406. A tang 456 extends downwardly past the hinge pin 406 and interacts with the case spring 454 to hold the case lid 404 in the closed position until opened by a user.

A fill valve assembly 460 is of conventional construction and is rotatably mounted in the through hole 424 in the frame 420. The fill valve assembly 460 is sealed to the through hole 424 by means of O-rings. The fill valve assembly 460 allows one to fill the interior space of the frame with butane and also allows one to adjust the height of the flame produced by the lighter as will hereinafter be described.

Referring again to FIGS. 18 and 19, a main valve assembly 464 is retained in the valve retaining tube 450 and protrudes through the through hole 448 at the top of the frame 420. The main valve assembly is shown in greater detail in FIG. 25. With reference to FIG. 25, the main valve assembly 464 comprises a valve body 466, a valve stem 468, a valve spring 470 and a valve seat 472. The valve body 466 is generally cylindrical with a downwardly extending tubular internal chamber 474 and an upwardly extending tubular chamber 476. The downwardly extending tubular chamber 474 is threaded over its lower portion and has a smooth sidewall near its top. A filter screen 478 is retained at the top of the downwardly extending tubular chamber by a compressible porous disk 480 some times known as a molt pran. The downwardly extending tubular chamber 474 and the upwardly extending tubular chamber 476 are interconnected by a passage 482. The passage 482 is surrounded by a raised lip 484 where it joins to the upwardly extending tubular chamber 476.

The valve stem 468 extends downwardly into the upwardly extending tubular chamber 476. The valve stem 468 is generally cylindrical with a central bore 490 communicating with a side aperture 492. The valve seat 472, which is rubber or another elastomer, is retained at the bottom of the valve stem 468. A stem collar 494 is immovably fixed to the valve stem 468 above the aperture 492. A valve sleeve 498 surrounds the valve stem 468 and is press fit into the valve body 466 closing the upwardly extending tubular chamber 476 and retaining the valve stem 468, valve spring 470 and valve seat 472 in the chamber. The spring 470 bears against the valve body 466 near the passage 482 and against the stem retaining collar 494. The valve spring 470 therefore urges the main valve into the open condition. In this condition, gas may flow through the downwardly extending tubular chamber 474, the passage 482, into the upwardly extending tubular chamber 474, through the side aperture 492 and out of the stem central bore 490. When a sufficient downwardly acting force is applied to the valve stem 468 as at the valve stem shoulder 496, the valve seat 472 will be urged against the lip 484 surrounding the passage 482 closing the valve.

With reference again to FIG. 25, a screen 486, a washer 487 and an orifice plate 488 sit on top of the valve stem 468. The orifice plate has very fine orifice 489, having a diameter of less than a thousandth of an inch, at its center. The main valve assembly of FIG. 25 is also usable in the embodiments of FIGS. 1-13.

With reference to FIGS. 18 and 19 a carburetor-diffuser assembly 530 is positioned on the top of the main valve assembly 464. The carburetor diffuser assembly comprises a tubular carburetor body 532, a diffuser 534 at the top of the carburetor body 532 and a ceramic insulator 536 surrounding the diffuser and extending upwardly from the diffuser. The carburetor body 532, the diffuser 534 and the ceramic insulator 536 are all permanently fixed together. The ceramic insulator is cylindrical and open in its top. It defines the burn chamber.

As can be seen in FIG. 19, the carburetor-diffuser assembly 530 is fixed to the top of the main valve assembly 464 by means of threads on the interior lower opening of the carburetor-diffuser assembly 530 mating with thread on the exterior upper surface of the valve stem 468.

With reference again to FIGS. 18 and 19, the main spring 502 is retained within the main spring retaining tower 438 and bears against the underside of the carriage assembly 504. The carriage assembly 504 comprises a carriage 506 which is die cast from zinc, aluminum or other suitable material, a liner 508 of a low friction polymer such as polytetrafluroethylene, a burn chamber door 510 and a door hinge pin 512. The door 510 is generally rectangular. It has two tabs which are bent into a circular shape having an internal opening accommodating the hinge pin 512. The door 510 is fixed to the carriage 504 at one end by the hinge pin 512. At the end of the door 510 remote from the hinge pin 512, a small door hole 516 is provided. The door 510 may rotate between a horizontal position where it closes a circular opening 518 in the top of the left portion of the carriage 504, and a vertical position where it opens this circular opening 518.

A rectangular opening 522 is provided in the top center of the carriage 504. the rectangular opening 522 is flanked on two sides by the side walls 504. Adjacent the rectangular opening 522 is a thumb button surface 524.

The carriage assembly 504 sits on the frame 420 with the thumb button surface 524 disposed above the main spring 502. A flint cartridge igniter assembly 542 has a cylindrical flint barrel 544 extending downwardly from a striker wheel 546. The striker wheel 546 is supported on a sheet metal bracket 548 having a rectangular base 550. The dimensions of the rectangular base 550 are somewhat larger than the dimensions of the rectangular opening 522 in the carriage 506. A striker wheel shroud 554 is disposed within the bracket and fixed to the bracket by means of the striker wheel rivet 556. The striker wheel shroud 554 optionally may include two arcuate portions 560 fixed to the rest of the shroud at one end only. If included, the two arcuate portions 560 have an outside diameter slightly greater than the outside diameter of the striker wheel 546. The two arcuate portions 560 are disposed one on each side of the striker wheel 546 and slightly radially outwardly from the outer surface of the striker wheel 546. The portions 560 may be omitted, while still remaining within the scope of the present invention. A flint 562 and flint advancing spring assembly 564 are contained within the flint barrel 544. The flint cartridge igniter assembly 542 is received in the flint and wheel igniter retaining tower 440 with the periphery of the rectangular base 550 resting upon the upper surface of the carriage assembly 504.

The shroud 570 acts as a wind screen around the area of combustion in the lighter when assembled and fixed to the case 402.

A burner door spring 576 comprises a base and two upstanding arms. The base of the burner door spring 560 is anchored to the top of the frame adjacent the case spring ring retaining tower 452. The upwardly extending arms of the burner door spring 576 engage tabs on the burn chamber door 510. The tabs are adjacent the hinge pin 512. The burner door spring 576 has a serpentine portion near its base allowing some give in the fit between the top of the frame 420 and the burn chamber door 510.

Referring again to FIG. 18, a lower fulcrum 580 projects from the bottom of the side of the igniter retaining tower 440. The lower fulcrum 580 has a rectangular base and a triangular upper segment terminating in a relatively pointed top fulcrum surface. Directly above the lower fulcrum 580 is an upper fulcrum 582. The upper fulcrum 582 is triangular in shape and has its sharp end pointed downwardly at the lower fulcrum 580. A space between the two fulcrums 580, 582 is provided. The space is wide enough to accommodate a valve actuator lever 588. The valve actuator lever 588 comprises two lever arms 590, 592. One lever arm is the mirror image of the other. The two lever arms are joined at one end by an actuator portion 594 having a U-shaped cut out 596 facing away from the lever arms.

Figure 20:
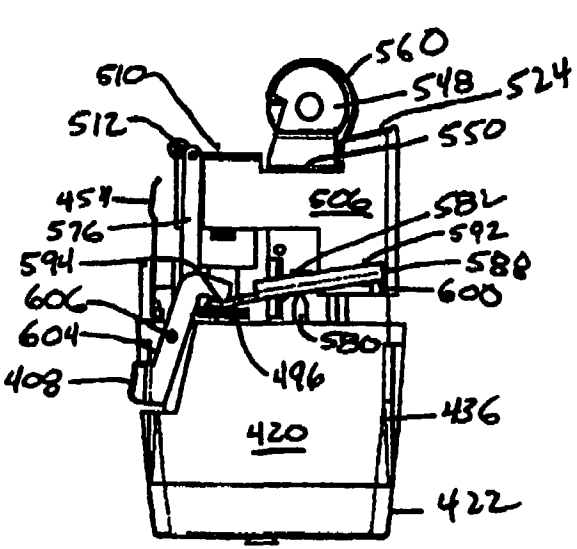
FIG. 20 is a front view of the lighter seen in FIGS. 16-19 with the case removed in the rest position.

The igniter retaining tower 440 has a second pair of fulcrums identical to the upper fulcrum 582 and lower fulcrum 580 on the opposite side of the tower 440. As can be seen in FIG. 20, the valve actuator lever 588 straddles the igniter retaining tower 440 and the lower extremity of the carriage 506. A lever support tab 600 extending from the side of the carriage 506 supports the end of the valve actuator lever 588 lever arm 592 remote from the U-shaped cut out 596. An identical lever support tab on the opposite side of the carriage 506 supports the other of the lever arms 590. In this position, the actuator portion 594 bears against the valve stem shoulder 496 which is retained in the U-shaped cut out 596. Thus, with the carriage 506 in the uppermost position, as biased by the main spring 502, the valve actuator lever exerts a downwardly directed force on the valve stem 468 counteracting the force of the valve spring 470 and holding the valve closed.

A valve release lever 604 is rotatable about tabs 606 on the frame 420. The lower end of the valve release lever 604 is the valve release button 408 seen in FIG. 16. With the valve release button 408 in the rest position, the upper end of the valve release lever 604 rests in hollows in the actuator portion 594 of the valve actuator lever 588. In this orientation, the valve actuator lever can not be raised adjacent the valve stem shoulder 496. The valve is held closed. The valve release lever 604 is biased into the rest position seen in FIG. 20 by an extension of the case spring 454. (The spring extension is not shown in the drawings). The spring extension exerts a clockwise torque valve release lever 604 resulting in a force applied to the valve system shoulder 496 larger than the opening force exerted by the valve spring 470. The main valve assembly 464 is held closed until the valve release button is forcefully depressed. Other biasing or spring loading mechanisms can be used. An extension of the door spring 576 can replace the case spring extensions. Alternatively, a coil spring can be positioned between the valve release button 408 and the frame 420.

FIG. 20 shows the principal elements of the lighter in the rest position. From this position, four things must be done to achieve ignition. First, the valve release button 408 must be depressed. This alone will do nothing except allow the valve actuator lever 588 to work when actuated. Secondly, the arcuate portions 560 of the striker wheel shroud 554 must be depressed so that the striker wheel 546 itself may be spun. It requires about 4 pounds of pressure to depress the arcuate portions 560 of the striker wheel shroud 554. This alone, again, will not cause ignition as the striker must still be turned. Third, the striker wheel must be rotated creating a spark. Fourth, the carriage 506 must be depressed allowing the valve actuator lever 588 to rotate about the fulcrums 580, 582 opening the main valve. The striker wheel shroud with its arcuate portions 560 and the valve release lever 604 are provided to prevent unintended ignition of the lighter or use by unauthorized persons.

The operation of the lighter in achieving a torch-like frame is hereinbelow described.

Figure 22:
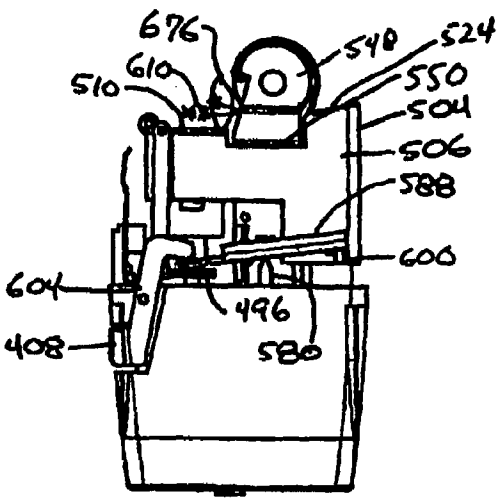
FIG. 22 is a front view of the lighter similar to FIG. 20 with the lighter in the primed position with a post mix flame.
Figure 21:
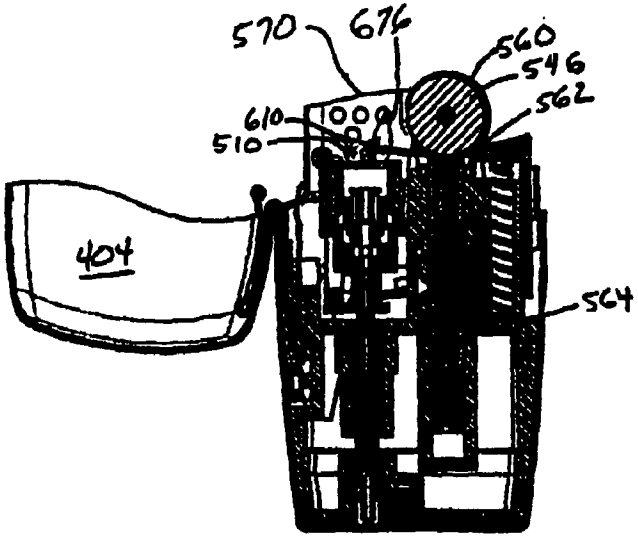
FIG. 21 is a vertical section similar to FIG. 19 showing the lighter in the primed position with a post mix flame.

With reference to FIGS. 19 and 20, the lighter 400 is seen in the rest position. The main valve is closed and no fuel is reaching the burn area. Referring now to FIGS. 21 and 22, the valve release button 408 has been depressed rotating the valve release lever 604 and freeing the actuator lever 588. An initial downward force has also been applied to the striker wheel 546 and shroud 554 and the striker rotated somewhat. The downward force on the striker wheel moves the carriage 506 down slightly. This moves the lever support tab 600 down slightly allowing the valve actuator lever 588 to rotate slightly in a clockwise direction. The valve spring 470 opens the main valve assembly 464 allowing butane gas to flow through the main valve, through the orifice 489 through the carburetor-diffuser assembly 530 and out the small door hole 516 in the burn chamber door 510. At this point, the butane gas is not mixed with air and the sparks 610 created by rotation of the striker ignite this gas into post-mix flame 676.

Figure 24:
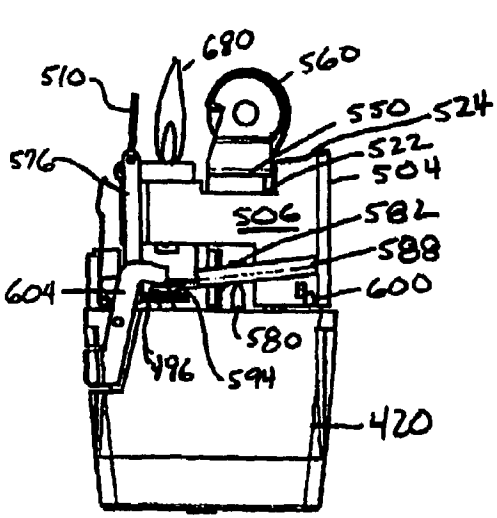
FIG. 24 is a front view of the lighter similar to FIGS. 20 and 22 with the lighter in the torch flame position.
Figure 23:
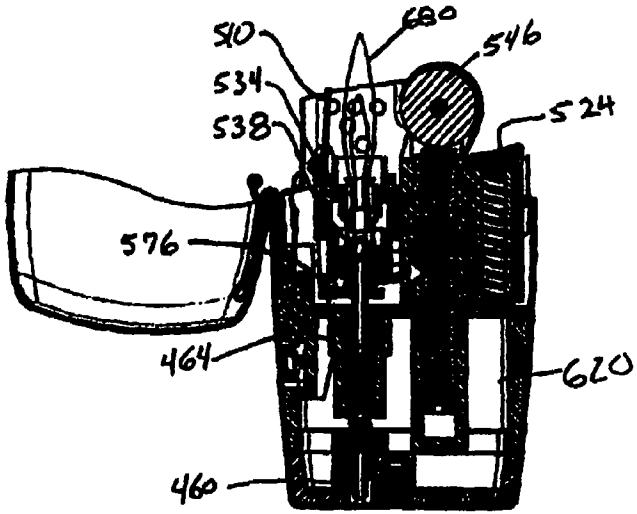
FIG. 23 is a vertical section similar to FIGS. 19 and 21 with the lighter in the torch flame position.

As the user's thumb slides off the striker wheel, it will depress the thumb button surface 524 on the carriage 506. The carriage 506 moves downwardly. Because the burner door spring 576 is fixed with relation to the frame 420, this will force the burn chamber door 510 to open as seen in FIG. 23 and FIG. 24. Additionally, the circular opening 518 and the stepped tube 520 below it move downwardly with respect to the carburetor-diffuser assembly 503 which the stepped tube surrounds. This exposes four lateral holes 538 in the carburetor body 532.

As described previously, the top of the main valve stem 468 is covered by an orifice plate 488 having an extremely small orifice in its center. The flow of gas below the orifice plate 488 is a high pressure, low velocity flow. The orifice 489 creates a low pressure, high velocity flow of fuel above the orifice plate. A high velocity low pressure jet of butane gas exits this orifice just below the four lateral holes 538 thereby creating a venturi effect and drawing air into the lateral holes 538. The same or similar structures are used in the embodiments of FIGS. 1-13 to achieve mixing of fuel and air. The butane gas and entrained air are mixed and formed into jets in the diffuser 534 forming a premix flame 680, the base of which is surrounded by the ceramic insulator 536 and a portion of which is surrounded by the shroud 570. For so long as the thumb button surface 524 is held in the depressed position, a torch-like premix flame will be maintained.

The size of the flame may be adjusted by turning the fill valve assembly 460. As the fill valve assembly 460 is threaded into the bottom of the main valve assembly 464, turning it in one direction will move it upwardly compressing the compressible disk 480. The compressed disk will admit less fuel into the main valve making for a smaller flame. Turning the fill valve assembly 460 in the opposite direction decompresses the compressible disk admitting more fuel into the main valve resulting in a larger flame.

Fuel is contained in the irregularly shaped volume 620 within the frame 420. It reaches the main valve through the downwardly extending tubular chamber 474 of the main valve assembly 464. The threaded connection of the chamber 474 to the fill valve assembly 460 is not gas tight.

When a user releases the thumb button surface 524, the main spring 502 urges the carriage assembly 504 in an upward direction which brings the lever support tabs 600 into contact with the valve actuator lever 588 thereby depressing the shoulder 496 on the valve stem 468 closing the valve and extinguishing the flame 680. At the same time, the burn chamber door 510 swings into the closed position. When the valve release button 408 is released, the valve release lever 604 swings back to the locked position. The lighter is now ready for stowage by closing the lid or another ignition by repeating the sequence described above.

The burn chamber door 510 covers and protects the carburetor-diffuser assembly 530 from flint debris when the striker wheel abrades the flint. Thus, flint particles, after performing their function of igniting a flame, either are retained on the top of the door 510 or fly completely across the top surface of the door. The small openings of the diffuser are not clogged. The carburetor-diffuser assembly 530 and the main valve assembly 464 are kept clean and operational.

Figure 26:
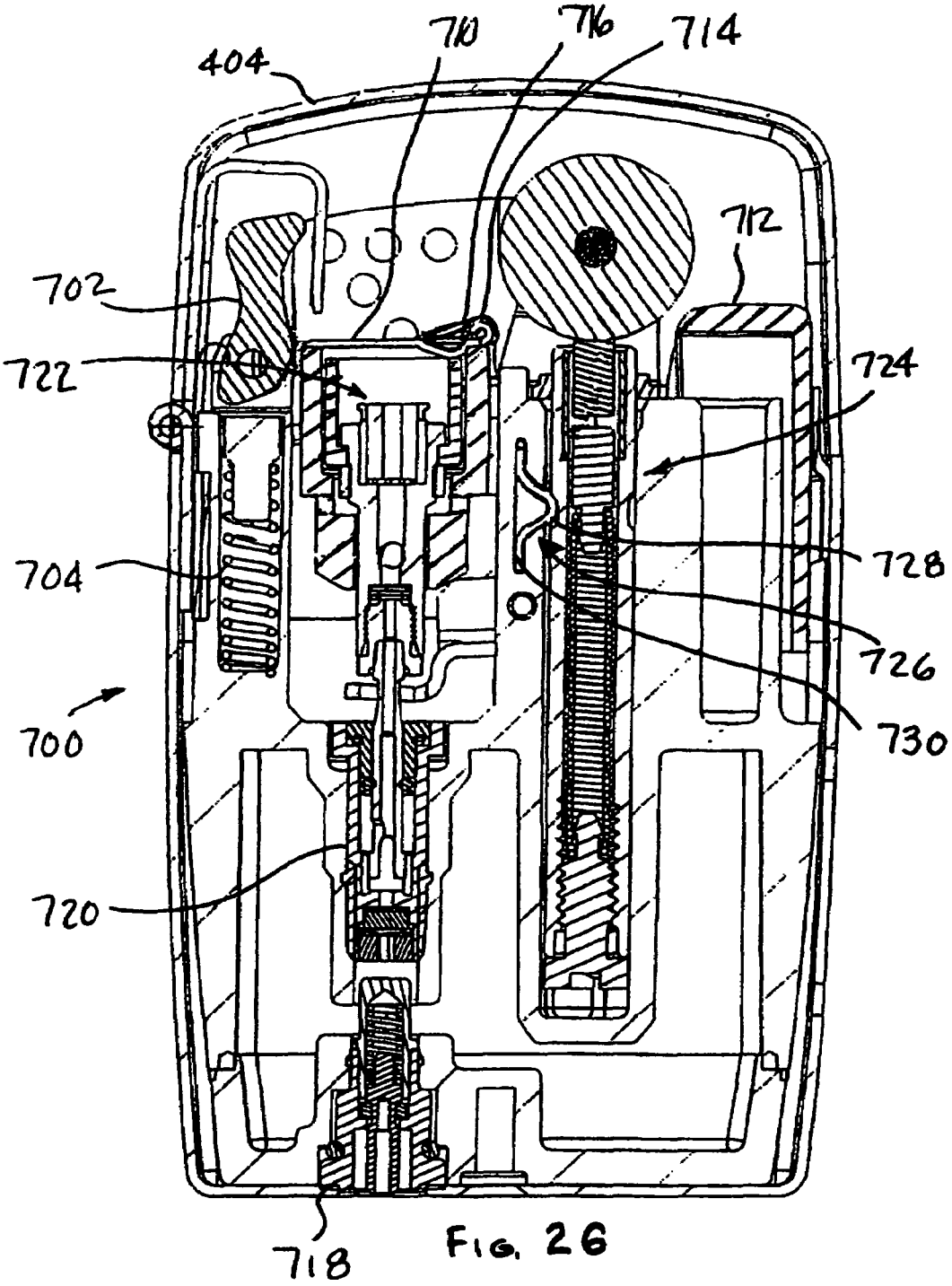
FIG. 26 is a vertical sectional view of an alternative embodiment of the present invention, shown with the cover closed.

Referring now to FIGS. 26-35, various details of a further embodiment of the present invention may be seen. In FIG. 26 lighter 700 has a cam 702 driven by a spring 704 to hold the case lid or cover 404 in the closed position as shown. In this embodiment a carriage 712 has a hinge 714 for door 710 located on the igniter side of the burner opening in the carriage 712. A spring 716 urges door 710 to the closed position when the lighter is not in use. This embodiment has a fill valve 718 and a gas valve 720 similar to those of the prior described embodiments. Lighter 700 has a carburetor diffuser assembly 722 corresponding to the assembly 530 described supra. A wheel and flint cartridge 724 is held in lighter 700 by a spring detent 726. Spring detent 726 includes a spring 728 biased toward the cartridge 724 and reacting against a wall 730.

Figure 27:
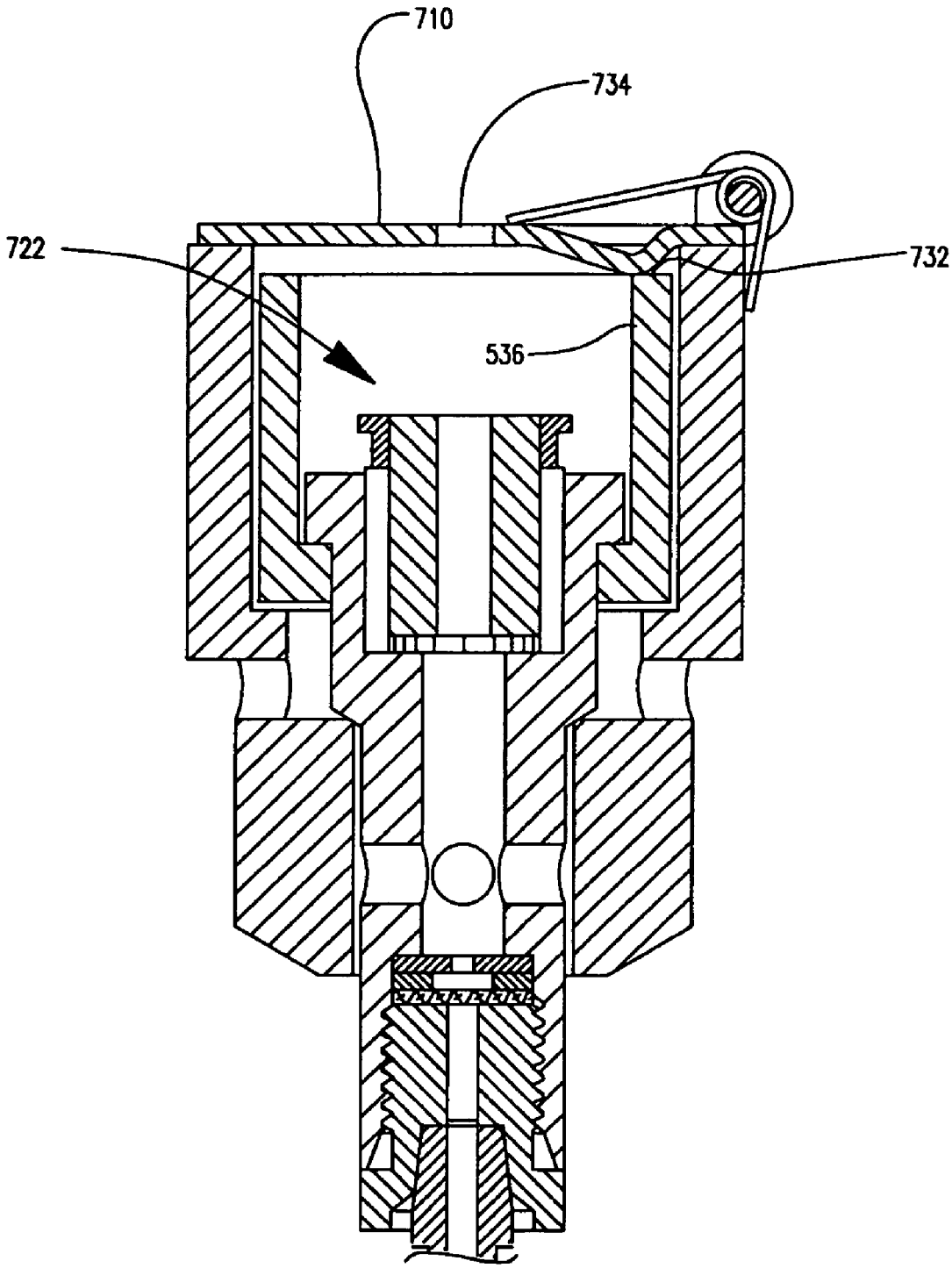
FIG. 27 is an enlarged detail view of the burner and a portion of a carriage from FIG. 26 in a closed position.
Figure 28:
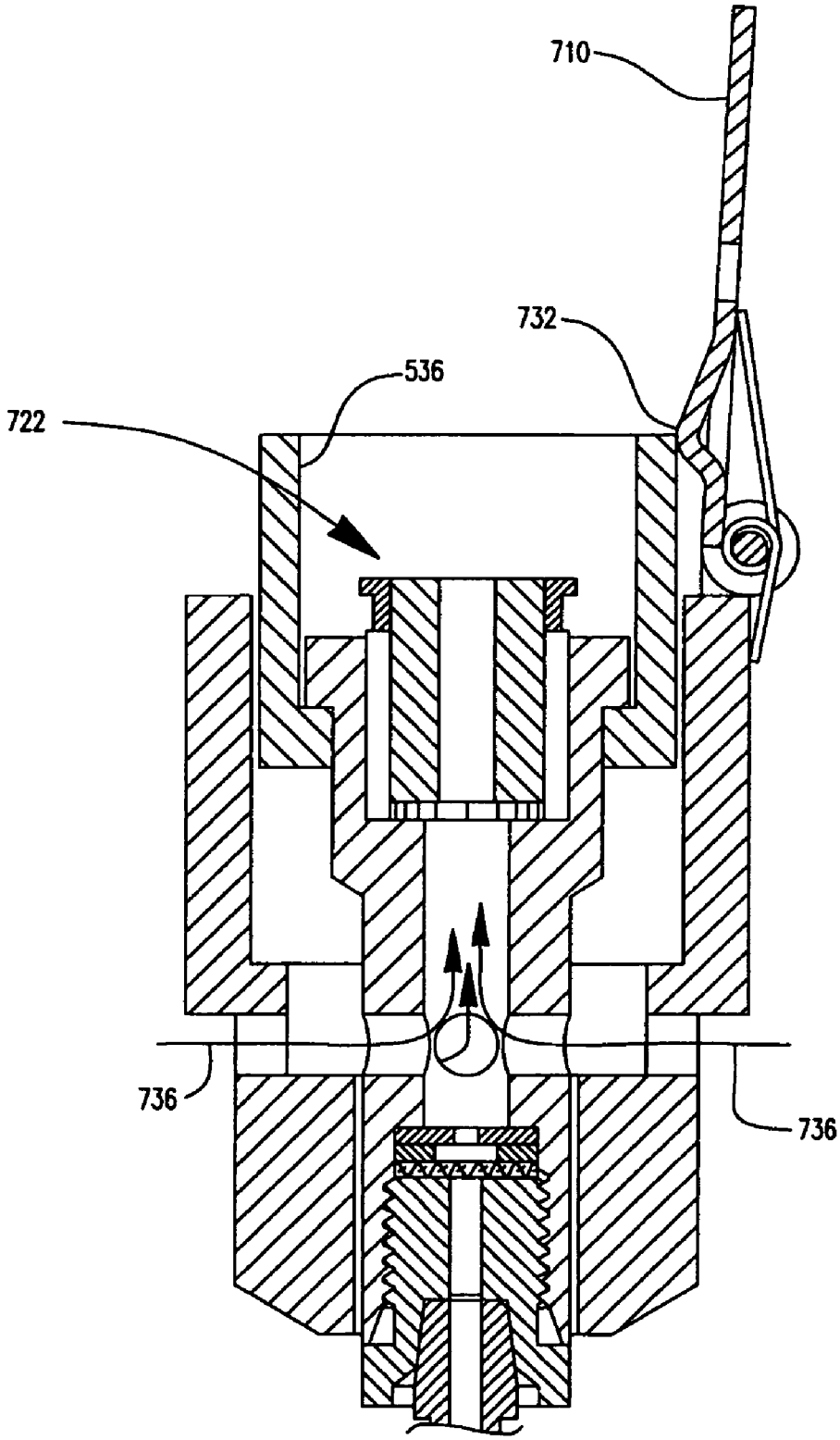
FIG. 28 is a view of the detail of FIG. 27, except with the burner advanced vertically to an open position.
Figure 29:
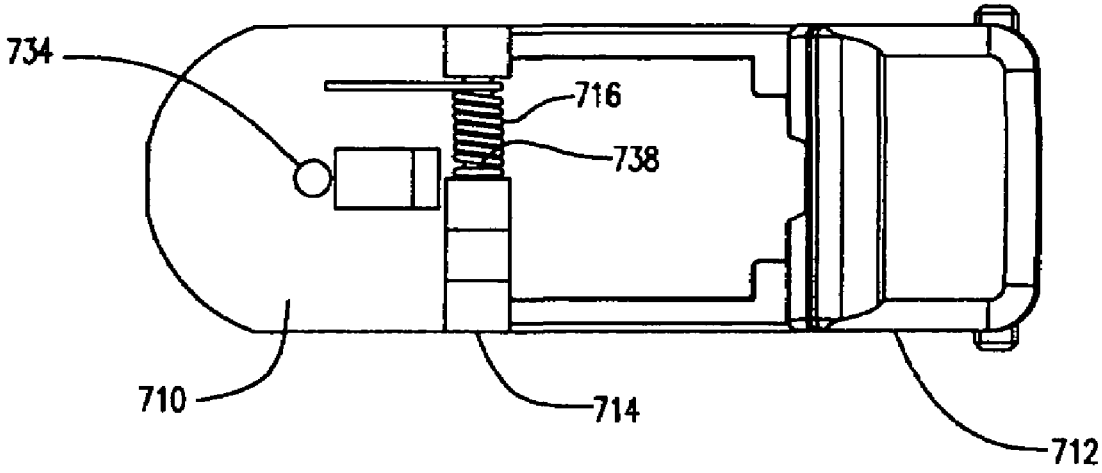
FIG. 29 is a top plan view of the carriage and door assembly of the embodiment of the lighter of FIG. 26.
Figure 30:
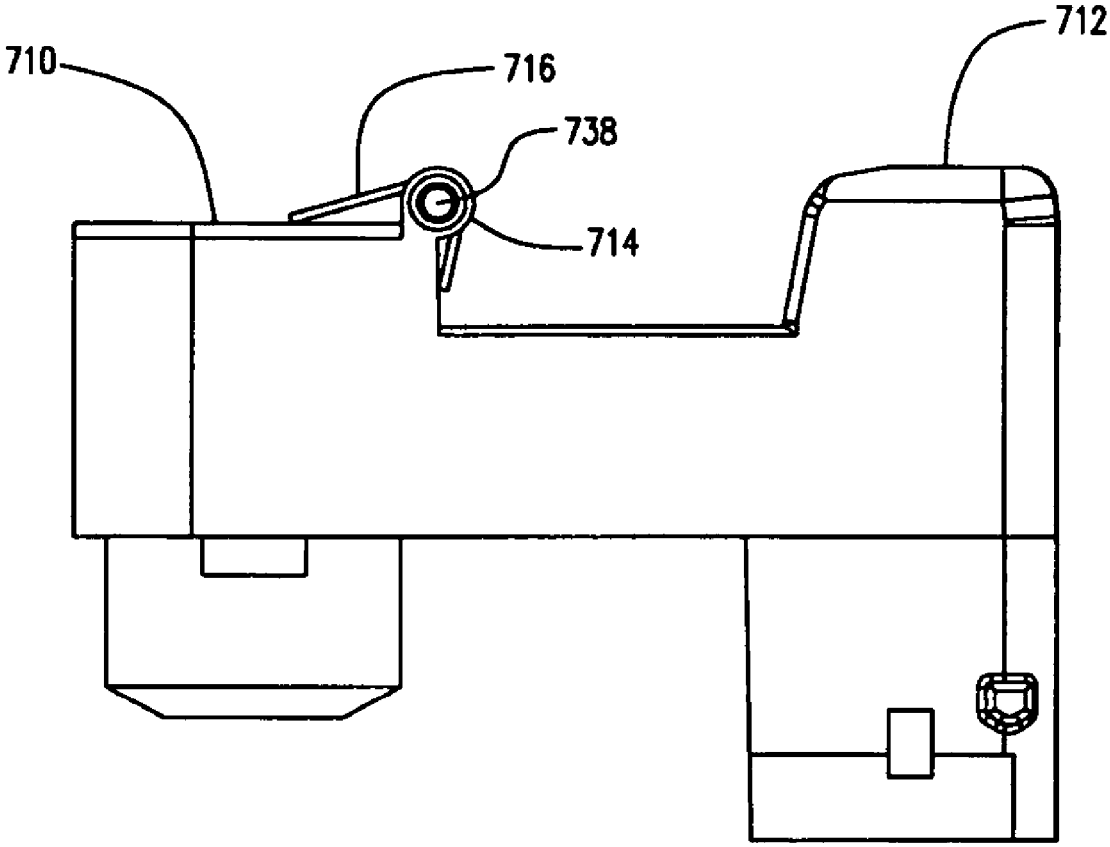
FIG. 30 is a side elevation view of the carriage and door assembly of FIG. 29.
Figure 31:
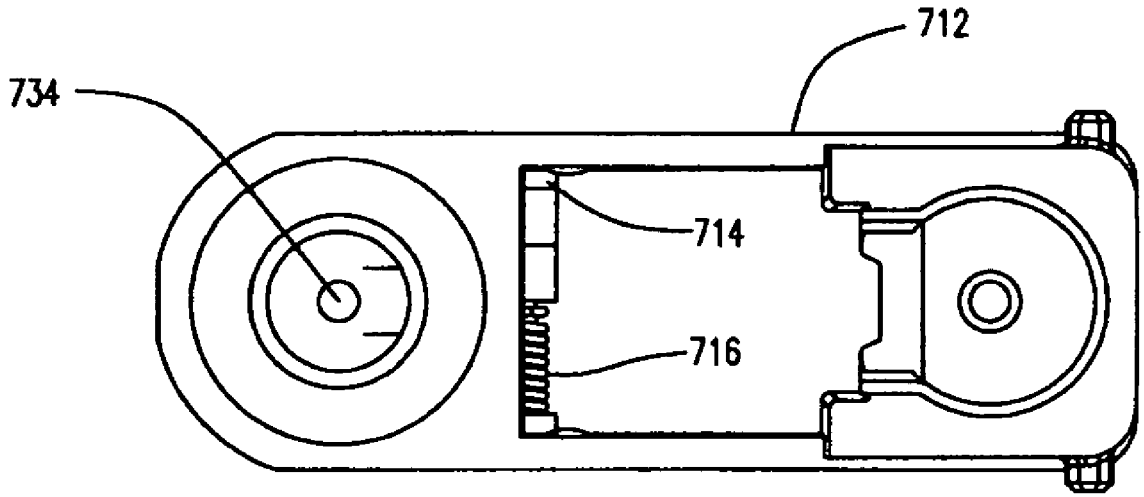
FIG. 31 is a bottom plan view of the carriage and door assembly of FIG. 29.
Figure 32:
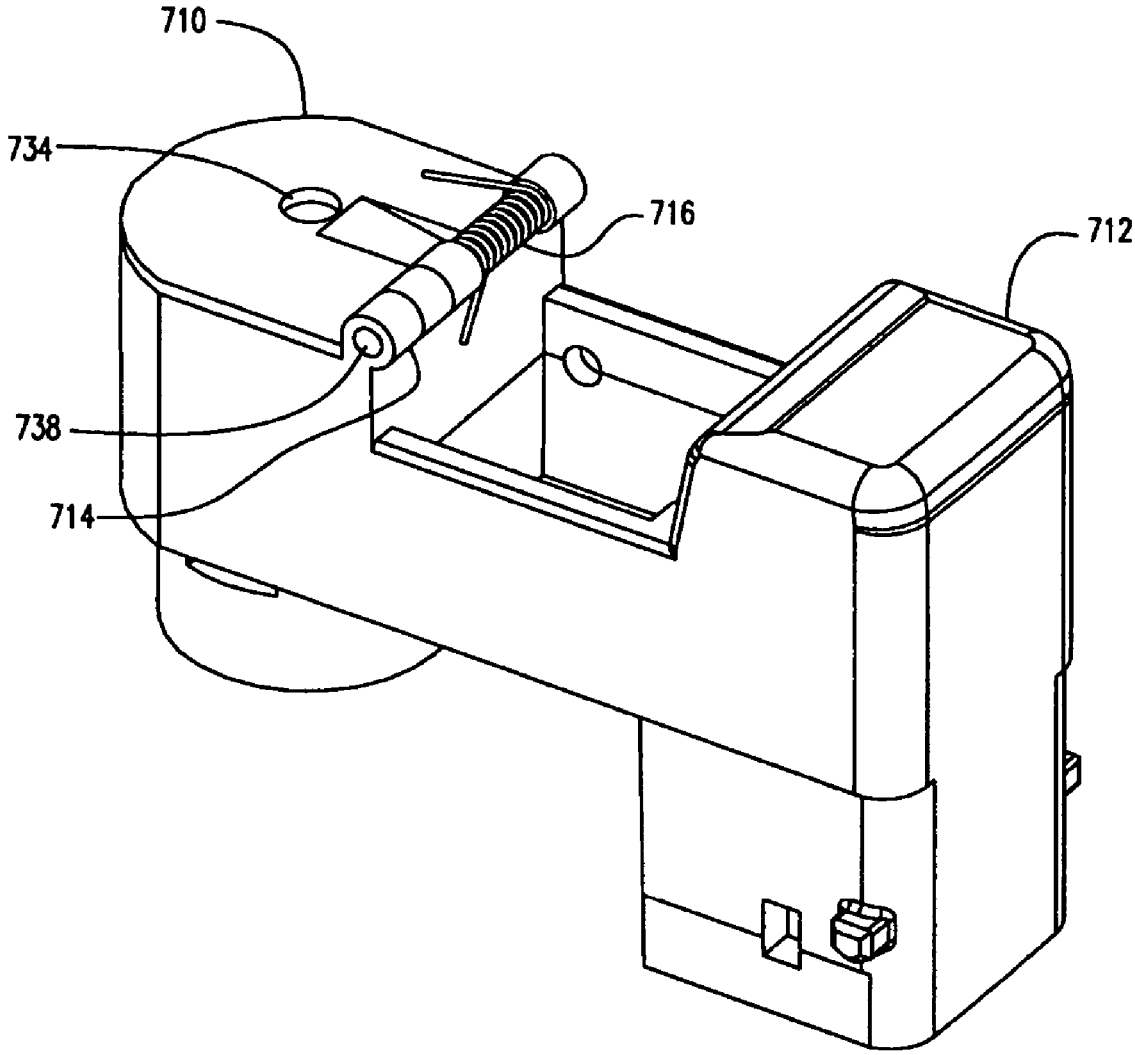
FIG. 32 is a perspective view of the carriage and door assembly of FIG. 29.
Figure 33:
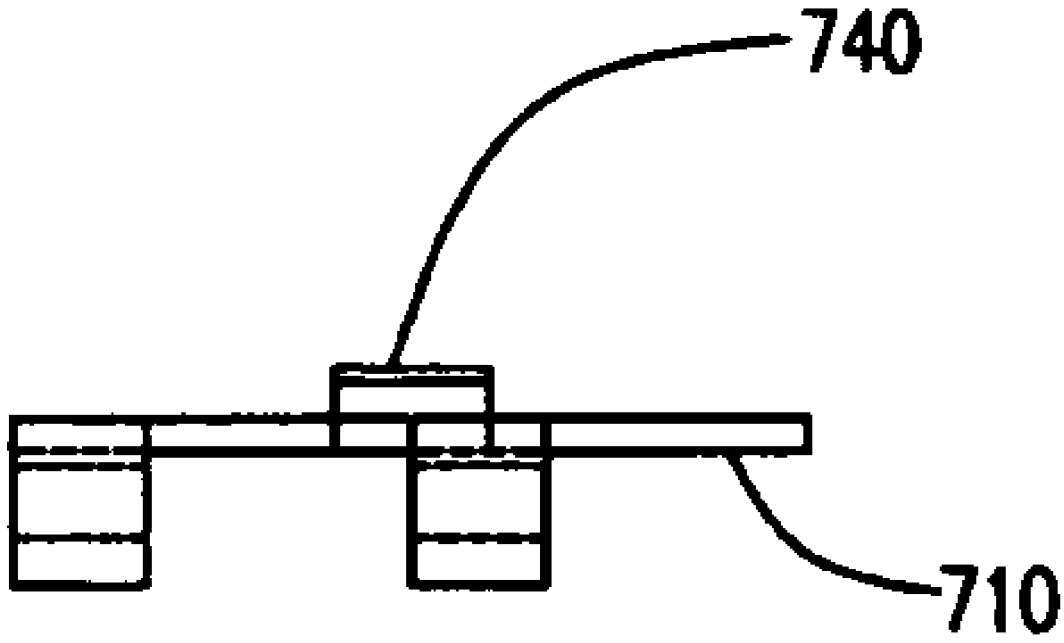
FIG. 33 is an end view of the door from the embodiment of the lighter shown in FIG. 26.
Figure 34:
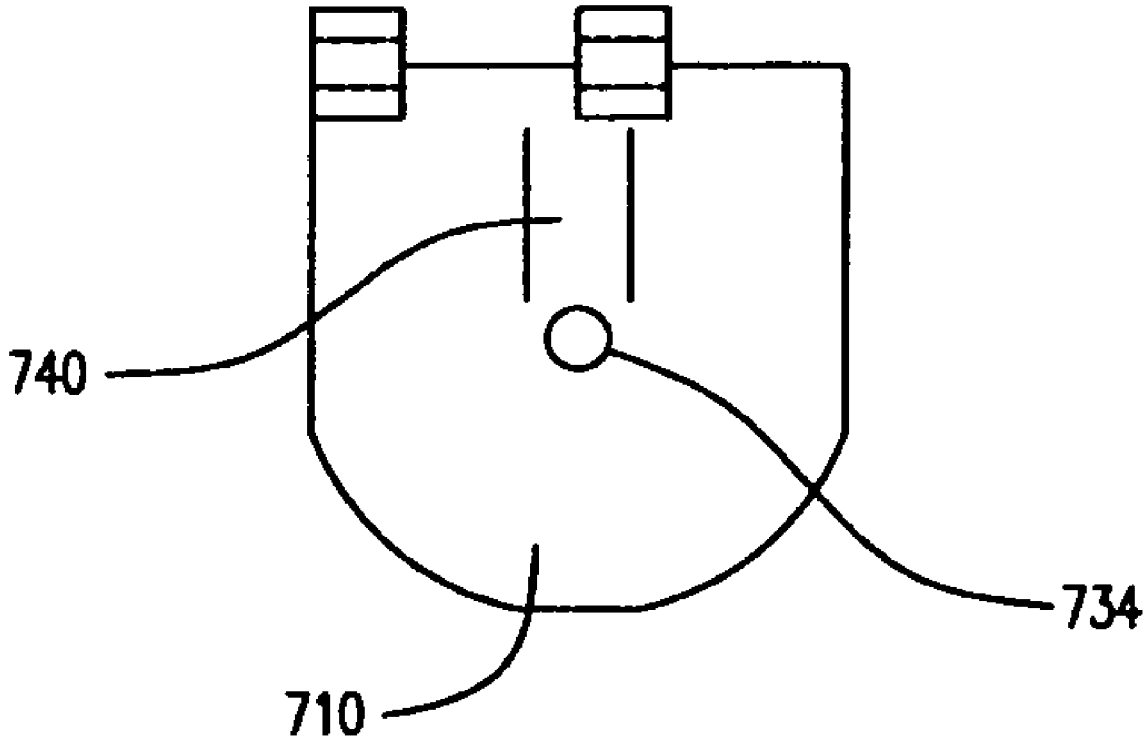
FIG. 34 is a top plan view of the door of FIG. 33.
Figure 35:
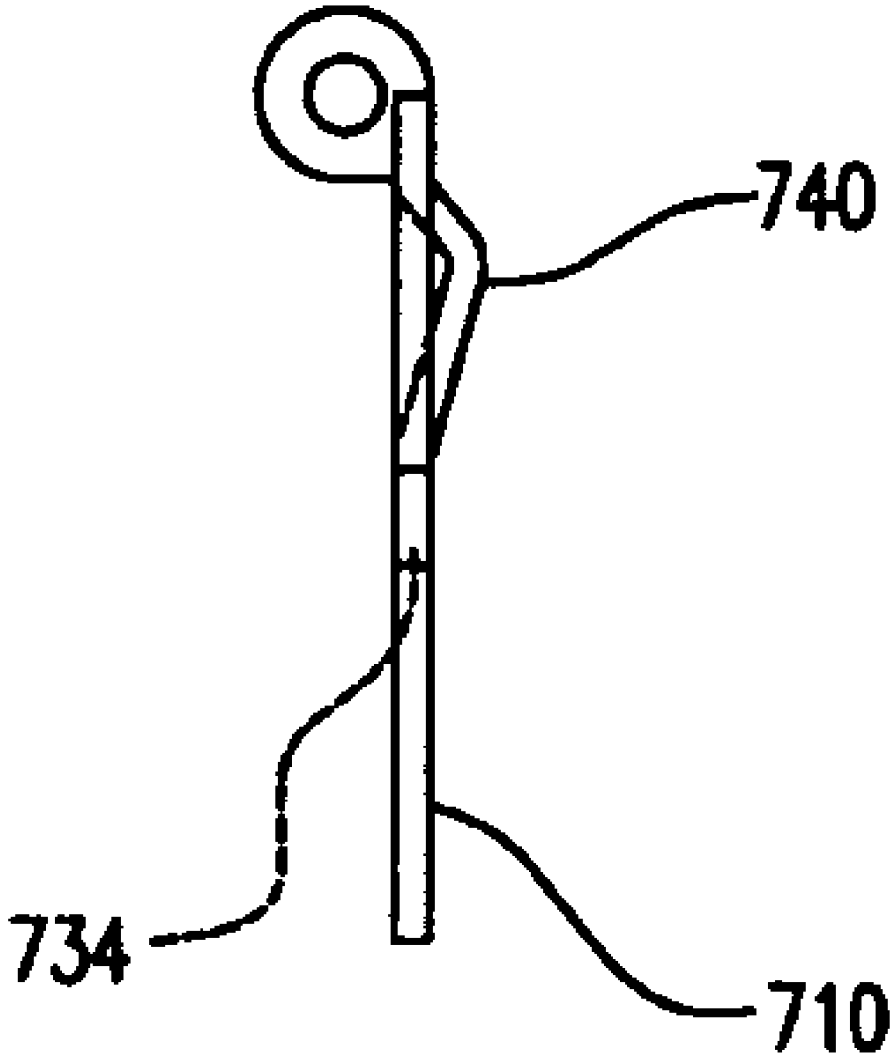
FIG. 35 is a side view of the door of FIG. 33.

Referring now most particularly to FIGS. 27 and 28, detail views of the carburetor diffuser assembly 722 along with a portion of the carriage 712 are shown with the door 710 in a closed position in FIG. 27, and with the door 710 in an open position in FIG. 28. Door 710 is opened by contact with an upper surface 732 of the ceramic piece 536 forming the burn chamber surrounding the assembly 722. It is to be understood that spring 716 keeps door 710 closed when the ceramic piece 536 is retracted (when the lighter is not in use, and initially, when ignition takes place, before the carburetor diffuser assembly is advanced, all as shown in FIG. 27. Once ignition has occurred, the carburetor diffuser assembly is advanced to the position shown in FIG. 28, elevating the ceramic insulator 536, opening the door 710.

Similarly to the embodiment of FIGS. 18 and 19, door 710 has a hole or aperture 734 through which fuel may exit when the door 710 is closed, permitting ignition of a post mix or yellow flame with the parts as shown in FIG. 27. Once door 710 opens, air is admitted in a pre mix configuration (as indicated by arrows 736 in FIG. 28) corresponding to the operation described above with respect to FIGS. 23 and 24, and a blue flame combustion occurs with the configuration shown in FIG. 28.

Referring now to FIGS. 20-35, various views of the carriage 712 and door 710 may be seen. It is to be understood that door 710 and spring 716 are held to the hinge 714 of carriage 712 by a hinge pin 738. Door 710 may have a protrusion 740 formed therein to contact the upper surface 732 of the ceramic piece, so that the door 710 is held further away from the flame in the open position than would otherwise be the case.

The invention has been described with reference to preferred embodiments. It will be appreciated that modifications and alterations could be made without deviating from the present invention. For instance, the rack and pinion arrangement described could be replaced by a lever or levers depressed at one end by the thumb button and elevating the elements raised by the lifter at the other end. Such modifications and alterations will occur to others upon the reading and understanding of the specification. It is intended that all such modifications and alterations be included in so far as they come within the scope of the appended claims or the equivalents thereof.

Having thus described the invention, it is claimed:

What is claimed is:

1. A lighter comprising:

a fuel reservoir adapted to contain a volatile fuel;

a fuel valve communicating with said fuel reservoir, said fuel valve having a closed state and an open state;

a mixer communicating with said fuel valve and adapted to receive fuel from said fuel valve and air from the surrounding atmosphere when said fuel valve is in the open state;

a combustion space communicating with said mixer, the combustion space having a top and a combustion space movable cover over the top of the combustion space; and a wheel and flint igniter adapted to direct incandescent sparks adjacent said combustion space whereby fuel and air from said combustion space is ignited, initiating combustion in said combustion space, wherein the wheel and flint igniter is mechanically coupled to said mixer and the lighter automatically provides fuel substantially unmixed with air when the wheel and flint igniter is operated and further wherein the lighter automatically provides fuel mixed with air following operation of said wheel and flint igniter while said fuel valve is in said open state; and wherein the combustion space movable cover has only a single aperture allowing the flow of gas from inside said combustion space to outside said combustion space when said top is closed.

2. The lighter of claim 1 further comprising an actuator positioned adjacent said wheel and flint igniter such that an operator's thumb will engage said actuator subsequent to initiating rotation of a wheel of said wheel and flint igniter, said actuator maintaining said fuel valve in the open state.

3. The lighter of claim 1 wherein said mixer has air inlets having an open state and a closed state and said mixer is adapted to draw air through said air inlets by a venturi effect when said air inlets are in said open state.

4. The lighter of claim 3 wherein an orifice is provided adjacent said air inlets, said orifice adapted to emit a narrow high speed jet of fuel gas when said fuel valve is in said open state thereby enhancing said venturi effect.

5. A lighter comprising:

a frame having a bottom and a top;

a fuel compartment in said frame;

a fuel fill valve disposed in said frame;

a fuel valve having an opened state and a closed state, the fuel valve dispensing fuel from said fuel compartment when in said opened state;

a fuel mixer having at least one air inlet having an opened state and a closed state, said fuel mixer receiving fuel from said fuel valve when said fuel valve is in said opened state and mixing said fuel with air when said at least one air inlet is in said opened state;

a burn chamber in fluid communication with said fuel mixer;

a flint and wheel igniter assembly proximate said burn chamber and directing sparks adjacent said burn chamber when actuated; and, a carriage, said carriage engaged by said flint and wheel igniter assembly when said carriage is in a rest position, said carriage having a thumb button surface proximate said flint and wheel igniter assembly and wherein said carriage is biased away from said frame, said carriage opening said fuel valve when said flint and wheel igniter assembly is actuated thereby initiating a postmix flame, and said at least one air inlet is opened when said thumb button surface is depressed toward said frame resulting in a premix flame.

6. The lighter of claim 5 wherein said fuel valve is normally biased to the opened state and said lighter further comprises an actuator urging said fuel valve into the closed state when said thumb button surface of said carriage is not depressed.

7. The lighter of claim 6 further comprising a main spring biasing said carriage into said rest position.

8. The lighter of claim 7 wherein said actuator is a valve actuating lever engaging said fuel valve at a valve actuating lever first end and being engaged at a valve actuating lever second end when said carriage is in said rest position whereby said fuel valve is held in said closed state.

9. The lighter of claim 8 wherein said lighter further comprises a valve release lever having a manually actuated valve release button at a valve release lever first end and engaging said valve actuating lever at a valve release lever second end, said valve release lever holding said valve actuating lever and said fuel valve in a closed state when said valve release button is not depressed and enabling the release of said valve actuating lever and said fuel valve when said valve release button is depressed.

10. A lighter comprising:

a fuel reservoir adapted to contain a volatile fuel:

a fuel valve communicating with said fuel reservoir, said fuel valve having a closed state and an open state;

a mixer communicating with said fuel valve and adapted to receive fuel from said fuel valve and air from the surrounding atmosphere when said fuel valve is in the open state;

a combustion space communicating with said mixer, the combustion space having a top and a combustion space movable cover over the top of the combustion space; and a wheel and flint igniter adapted to direct incandescent sparks adjacent said combustion space whereby fuel and air from said combustion space is ignited, initiating combustion in said combustion space, wherein the wheel and flint igniter is mechanically coupled to said mixer and the lighter automatically provides fuel substantially unmixed with air when the wheel and flint igniter is operated and further wherein the lighter automatically provides fuel mixed with air following operation of said wheel and flint igniter while said fuel valve is in said open state; and wherein the combustion space movable cover has only a single aperture adjacent thereto allowing the flow of gas from inside said combustion space to outside said combustion space when said top is closed and said wheel and flint igniter directs incandescent sparks over said combustion space movable cover adjacent said single aperture.

* * * * *